US009454974B2

(12) United States Patent
Krishnan et al.

(10) Patent No.: US 9,454,974 B2
(45) Date of Patent: Sep. 27, 2016

(54) SYSTEMS, METHODS, AND APPARATUS FOR GAIN FACTOR LIMITING

(75) Inventors: Venkatesh Krishnan, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 3119 days.

(21) Appl. No.: 11/610,104

(22) Filed: Dec. 13, 2006

(65) Prior Publication Data

US 2008/0027718 A1 Jan. 31, 2008

Related U.S. Application Data

(60) Provisional application No. 60/834,658, filed on Jul. 31, 2006.

(51) Int. Cl.

| | |
|---|---|
| ***G10L 19/14*** | (2006.01) |
| ***G10L 21/038*** | (2013.01) |
| *G10L 19/02* | (2013.01) |
| *G10L 25/18* | (2013.01) |

(52) U.S. Cl.
CPC ..... *G10L 21/038* (2013.01); *G10L 19/0204* (2013.01); *G10L 25/18* (2013.01)

(58) Field of Classification Search
USPC ..... 704/211, 500, 223, 219, 205, 230, 264
See application file for complete search history.

(56) References Cited

U.S. PATENT DOCUMENTS

| | | | | |
|---|---|---|---|---|
| 5,519,807 | A * | 5/1996 | Cellario et al. | 704/224 |
| 6,260,010 | B1 * | 7/2001 | Gao et al. | 704/230 |
| 6,324,505 | B1 * | 11/2001 | Choy et al. | 704/230 |
| 6,397,178 | B1 * | 5/2002 | Benyassine | 704/230 |
| 6,732,070 | B1 | 5/2004 | Rotola-Pukkila et al. | |
| 6,988,066 | B2 | 1/2006 | Malah | |
| 2002/0072899 | A1 | 6/2002 | Paksoy | |
| 2003/0014249 | A1 * | 1/2003 | Ramo | 704/230 |
| 2003/0036382 | A1 * | 2/2003 | Chen | 455/423 |
| 2004/0002856 | A1 | 1/2004 | Bhaskar | |
| 2004/0019492 | A1 * | 1/2004 | Tucker et al. | 704/500 |
| 2004/0093205 | A1 | 5/2004 | Ashley | |
| 2004/0101038 | A1 | 5/2004 | Etter | |

(Continued)

FOREIGN PATENT DOCUMENTS

| | | |
|---|---|---|
| CN | 1150853 A | 5/1997 |
| EP | 0414193 | 2/1991 |

(Continued)

OTHER PUBLICATIONS

Yasheng Qian et al., "Wideband Speech Recovery From Narrowband Speech Using Classified Codebook Mapping", 2002, pp. 106-111.*

(Continued)

*Primary Examiner* — Richemond Dorvil
*Assistant Examiner* — Mark Villena
(74) *Attorney, Agent, or Firm* — Heejong Yoo

(57) ABSTRACT

The range of disclosed configurations includes methods in which subbands of a speech signal are separately encoded, with the excitation of a first subband being derived from a second subband. Gain factors are calculated to indicate a time-varying relation between envelopes of the original first subband and of the synthesized first subband. The gain factors are quantized, and quantized values that exceed the pre-quantized values are re-coded.

28 Claims, 24 Drawing Sheets

(56) References Cited

U.S. PATENT DOCUMENTS

| | | | | |
|---|---|---|---|---|
| 2004/0260545 | A1 | 12/2004 | Gao | |
| 2005/0004793 | A1* | 1/2005 | Ojala et al. | 704/219 |
| 2005/0065785 | A1 | 3/2005 | Bessette | |
| 2005/0137864 | A1* | 6/2005 | Valve et al. | 704/227 |
| 2005/0143980 | A1* | 6/2005 | Huang | 704/208 |
| 2005/0187759 | A1 | 8/2005 | Malah | |
| 2005/0246164 | A1* | 11/2005 | Ojala et al. | 704/205 |
| 2005/0251387 | A1* | 11/2005 | Jelinek et al. | 704/223 |
| 2006/0271357 | A1* | 11/2006 | Wang et al. | 704/223 |
| 2006/0277039 | A1 | 12/2006 | Vos | |

FOREIGN PATENT DOCUMENTS

| | | | | |
|---|---|---|---|---|
| EP | 1498873 | | 1/2005 | |
| JP | 2143712 | A | 6/1990 | |
| JP | 8030295 | A | 2/1996 | |
| JP | 8123500 | A | 5/1996 | |
| JP | 09230897 | | 9/1997 | |
| RU | 2233010 | | 7/2004 | |
| WO | 9634383 | | 10/1996 | |
| WO | WO 9634383 | A1 * | 10/1996 | G10L 9/18 |
| WO | WO0156021 | A1 | 8/2001 | |
| WO | WO2006049205 | A1 | 5/2006 | |

OTHER PUBLICATIONS

International Search Report—PCT/US07/07494—International Search Authority, European Patent Office, Mar. 25, 2006.

Nilsson, M et al.,: "Avoiding Oyer-Estimation in Bandwidth Extension of Telephony Speech," 2001 IEEE International Conference on Acoustics, Speech, and Signal Processing Proceedings(ICASSP) May 7, 2001.

Epps, J., Wideband Extension of Narrowband Speech for Enhancement and Coding. Ph.D thesis, Univ. of New South Wales, Sep. 2000. Cover and chapter 7 (pp. 122-129).

Qian, Y. et al. Classified Highband Excitation for Bandwidth Extension of Telephony Signals. Proc. Euro. Sig. Proc. Conf., Antalya, Turkey, Sep. 2005 (4 pp.).

Enhanced Variable Rate Codec, Speech Service Options 3, 68, and 70 for Wideband Spread Spectrum Digital Systems. 3GPP2 C.P0014-C version 0.4, Oct. 2006. Accessed Dec. 7, 2006 at www.3gpp2.org/Public_html/Misc/C.P0014-C_VV_Due_1_ Dec-2006.pdf. Cover, section 4.3 (pp. 4-17 to 4-23), and section 4.18 (pp. 4-163 to 4-167).

Filtering, Journal of the Institute of Electronics, Information and Communication Engineers, Feb. 1, 2006, Vo. J89-D, No. 2, pp. 281-291.

Oshikiri M., et al., "AMR Narrowband/Broadband Scalable Speech Coding Method," Proceedings (CD-ROM) of 2006 Spring Meeting of the Acoustic Society of Japan, Mar. 7, 2006, pp. 389-390.

Written Opinion—PCT/US2007/074794, International Search Authority—European Patent Office—Mar. 25, 2008.

* cited by examiner

SYSTEMS, METHODS, AND APPARATUS FOR GAIN FACTOR LIMITING

RELATED APPLICATIONS

This application claims benefit of U.S. Provisional Pat. Appl. No. 60/834,658, filed Jul. 31, 2006 and entitled "METHOD FOR QUANTIZATION OF FRAME GAIN IN A WIDEBAND SPEECH CODER."

FIELD

This disclosure relates to speech encoding.

BACKGROUND

Voice communications over the public switched telephone network (PSTN) have traditionally been limited in bandwidth to the frequency range of 300-3400 kHz. New networks for voice communications, such as cellular telephony and voice over IP (Internet Protocol, VOIP), may not have the same bandwidth limits, and it may be desirable to transmit and receive voice communications that include a wideband frequency range over such networks. For example, it may be desirable to support an audio frequency range that extends down to 50 Hz and/or up to 7 or 8 kHz. It may also be desirable to support other applications, such as high-quality audio or audio/video conferencing, that may have audio speech content in ranges outside the traditional PSTN limits.

Extension of the range supported by a speech coder into higher frequencies may improve intelligibility. For example, the information that differentiates fricatives such as 's' and 'f' is largely in the high frequencies. Highband extension may also improve other qualities of speech, such as presence. For example, even a voiced vowel may have spectral energy far above the PSTN limit.

One approach to wideband speech coding involves scaling a narrowband speech coding technique (e.g., one configured to encode the range of 0-4 kHz) to cover the wideband spectrum. For example, a speech signal may be sampled at a higher rate to include components at high frequencies, and a narrowband coding technique may be reconfigured to use more filter coefficients to represent this wideband signal. Narrowband coding techniques such as CELP (codebook excited linear prediction) are computationally intensive, however, and a wideband CELP coder may consume too many processing cycles to be practical for many mobile and other embedded applications. Encoding the entire spectrum of a wideband signal to a desired quality using such a technique may also lead to an unacceptably large increase in bandwidth. Moreover, transcoding of such an encoded signal would be required before even its narrowband portion could be transmitted into and/or decoded by a system that only supports narrowband coding.

It may be desirable to implement wideband speech coding such that at least the narrowband portion of the encoded signal may be sent through a narrowband channel (such as a PSTN channel) without transcoding or other significant modification. Efficiency of the wideband coding extension may also be desirable, for example, to avoid a significant reduction in the number of users that may be serviced in applications such as wireless cellular telephony and broadcasting over wired and wireless channels.

Another approach to wideband speech coding involves coding the narrowband and highband portions of a speech signal as separate subbands. In a system of this type, an increased efficiency may be realized by deriving an excitation for the highband synthesis filter from information already available at the decoder, such as the narrowband excitation signal. Quality may be increased in such a system by including in the encoded signal a series of gain factors that indicate a time-varying relation between a level of the original highband signal and a level of the synthesized highband signal.

SUMMARY

A method of speech processing according to one configuration includes calculating a gain factor based on a relation between (A) a portion in time of a first signal based on a first subband of a speech signal and (B) a corresponding portion in time of a second signal based on a component derived from a second subband of the speech signal; and selecting, according to the gain factor value, a first index into an ordered set of quantization values. The method includes evaluating a relation between the gain factor value and a quantization value indicated by the first index; and selecting, according to a result of the evaluating, a second index into the ordered set of quantization values.

An apparatus for speech processing according to another configuration includes a calculator configured to calculate a gain factor value based on a relation between (A) a portion in time of a first signal based on a first subband of a speech signal and (B) a corresponding portion in time of a second signal based on a component derived from a second subband of the speech signal; and a quantizer configured to select, according to the gain factor value, a first index into an ordered set of quantization values. The apparatus includes a limiter configured (A) to evaluate a relation between the gain factor value and a quantization value indicated by the first index and (B) to select, according to a result of the evaluation, a second index into the ordered set of quantization values.

An apparatus for speech processing according to a further configuration includes means for calculating a gain factor value based on a relation between (A) a portion in time of a first signal based on a first subband of a speech signal and (B) a corresponding portion in time of a second signal based on a component derived from a second subband of the speech signal; and means for selecting, according to the gain factor value, a first index into an ordered set of quantization values. The apparatus includes means for evaluating a relation between the gain factor value and a quantization value indicated by the first index and for selecting, according to a result of the evaluating, a second index into the ordered set of quantization values.

DETAILED DESCRIPTION

An audible artifact may occur when, for example, the energy distribution among the subbands of a decoded signal is inaccurate. Such an artifact may be noticeably unpleasant to a user and thus may reduce the perceived quality of the coder.

Unless expressly limited by its context, the term "calculating" is used herein to indicate any of its ordinary meanings, such as computing, generating, and selecting from a list of values. Where the term "comprising" is used in the present description and claims, it does not exclude other elements or operations. The term "A is based on B" is used to indicate any of its ordinary meanings, including the cases (i) "A is equal to B" and (ii) "A is based on at least B." The term "Internet Protocol" includes version 4, as described in IETF (Internet Engineering Task Force) RFC (Request for Comments) 791, and subsequent versions such as version 6.

Figure 1A:
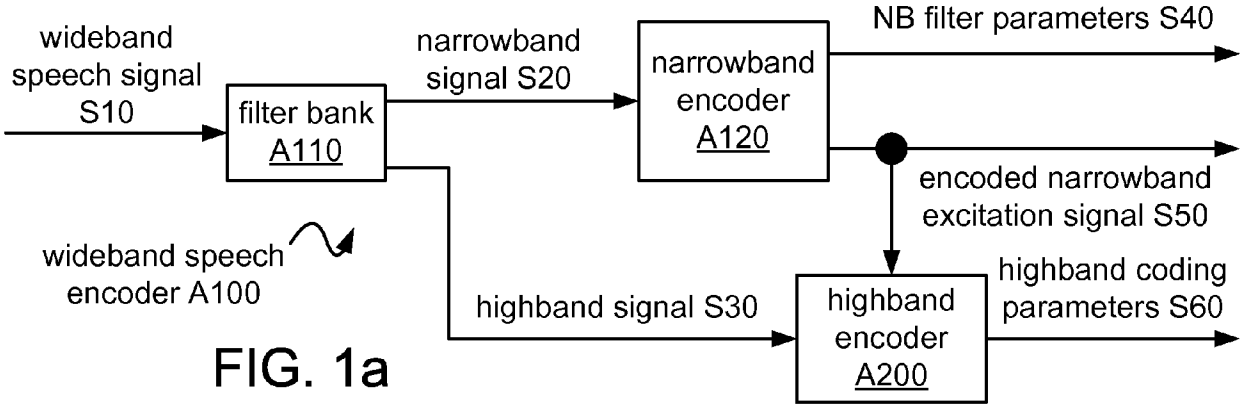
FIG. 1*a* shows a block diagram of a wideband speech encoder A100.

FIG. 1*a* shows a block diagram of a wideband speech encoder A100 that may be configured to perform a method as described herein. Filter bank A110 is configured to filter a wideband speech signal S10 to produce a narrowband signal S20 and a highband signal S30. Narrowband encoder A120 is configured to encode narrowband signal S20 to produce narrowband (NB) filter parameters S40 and a narrowband residual signal S50. As described in further detail herein, narrowband encoder A120 is typically configured to produce narrowband filter parameters S40 and encoded narrowband excitation signal S50 as codebook indices or in another quantized form. Highband encoder A200 is configured to encode highband signal S30 according to information in encoded narrowband excitation signal S50 to produce highband coding parameters S60. As described in further detail herein, highband encoder A200 is typically configured to produce highband coding parameters S60 as codebook indices or in another quantized form. One particular example of wideband speech encoder A100 is configured to encode wideband speech signal S10 at a rate of about 8.55 kbps (kilobits per second), with about 7.55 kbps being used for narrowband filter parameters S40 and encoded narrowband excitation signal S50, and about 1 kbps being used for highband coding parameters S60.

Figure 1B:
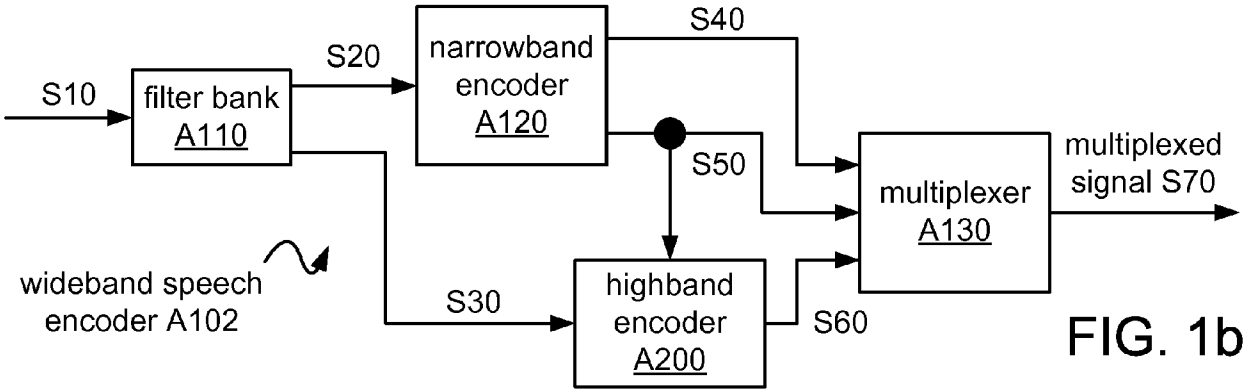
FIG. 1*b* shows a block diagram of an implementation A102 of wideband speech encoder A100.

It may be desired to combine the encoded narrowband and highband signals into a single bitstream. For example, it may be desired to multiplex the encoded signals together for transmission (e.g., over a wired, optical, or wireless transmission channel), or for storage, as an encoded wideband speech signal. FIG. 1*b* shows a block diagram of an implementation A102 of wideband speech encoder A100 that includes a multiplexer A130 configured to combine narrowband filter parameters S40, encoded narrowband excitation signal S50, and highband filter parameters S60 into a multiplexed signal S70.

An apparatus including encoder A102 may also include circuitry configured to transmit multiplexed signal S70 into a transmission channel such as a wired, optical, or wireless channel. Such an apparatus may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, TCP/IP, cdma2000).

It may be desirable for multiplexer A130 to be configured to embed the encoded narrowband signal (including narrowband filter parameters S40 and encoded narrowband excitation signal S50) as a separable substream of multiplexed signal S70, such that the encoded narrowband signal may be recovered and decoded independently of another portion of multiplexed signal S70 such as a highband and/or lowband signal. For example, multiplexed signal S70 may be arranged such that the encoded narrowband signal may be recovered by stripping away the highband filter parameters S60. One potential advantage of such a feature is to avoid the need for transcoding the encoded wideband signal before passing it to a system that supports decoding of the narrowband signal but does not support decoding of the highband portion.

Figure 2A:
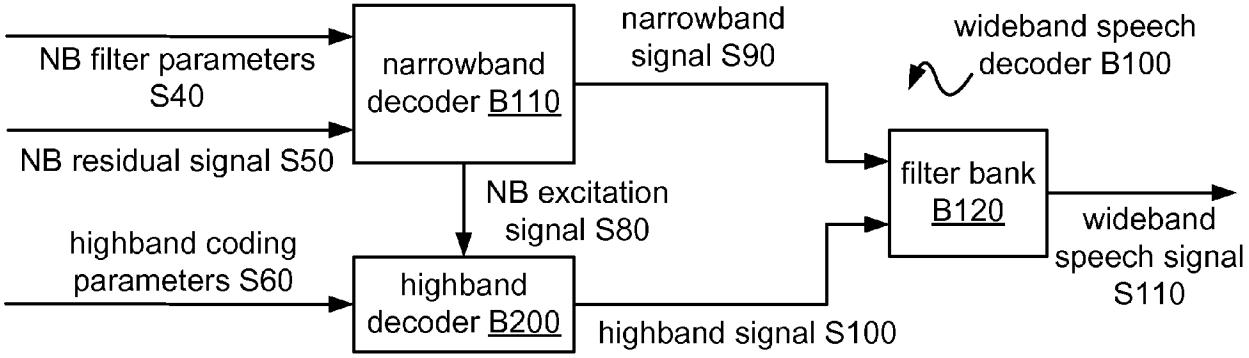
FIG. 2*a* shows a block diagram of a wideband speech decoder B100.

FIG. 2*a* is a block diagram of a wideband speech decoder B100 that may be used to decode a signal encoded by wideband speech encoder A100. Narrowband decoder B110 is configured to decode narrowband filter parameters S40 and encoded narrowband excitation signal S50 to produce a narrowband signal S90. Highband decoder B200 is configured to decode highband coding parameters S60 according to a narrowband excitation signal S80, based on encoded narrowband excitation signal S50, to produce a highband signal S100. In this example, narrowband decoder B110 is configured to provide narrowband excitation signal S80 to highband decoder B200. Filter bank B120 is configured to combine narrowband signal S90 and highband signal S100 to produce a wideband speech signal S110.

Figure 2B:
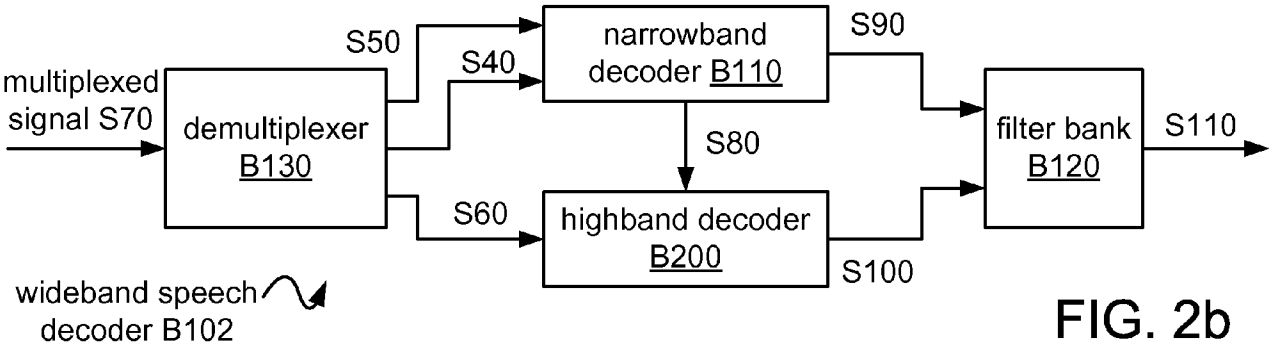
FIG. 2*b* shows a block diagram of an implementation B102 of wideband speech decoder B100.

FIG. 2*b* is a block diagram of an implementation B102 of wideband speech decoder B100 that includes a demultiplexer B130 configured to produce encoded signals S40, S50, and S60 from multiplexed signal S70. An apparatus including decoder B102 may include circuitry configured to receive multiplexed signal S70 from a transmission channel such as a wired, optical, or wireless channel. Such an apparatus may also be configured to perform one or more channel decoding operations on the signal, such as error correction decoding (e.g., rate-compatible convolutional decoding) and/or error detection decoding (e.g., cyclic redundancy decoding), and/or one or more layers of network protocol decoding (e.g., Ethernet, TCP/IP, cdma2000).

Filter bank A110 is configured to filter an input signal according to a split-band scheme to produce a low-frequency subband and a high-frequency subband. Depending on the design criteria for the particular application, the output subbands may have equal or unequal bandwidths and may be overlapping or nonoverlapping. A configuration of filter bank A110 that produces more than two subbands is also possible. For example, such a filter bank may be configured to produce one or more lowband signals that include components in a frequency range below that of narrowband signal S20 (such as the range of 50-300 Hz). It is also possible for such a filter bank to be configured to produce one or more additional highband signals that include components in a frequency range above that of highband signal S30 (such as a range of 14-20, 16-20, or 16-32 kHz). In such case, wideband speech encoder A100 may be implemented to encode this signal or signals separately, and multiplexer A130 may be configured to include the additional encoded signal or signals in multiplexed signal S70 (e.g., as a separable portion).

Figure 3B:
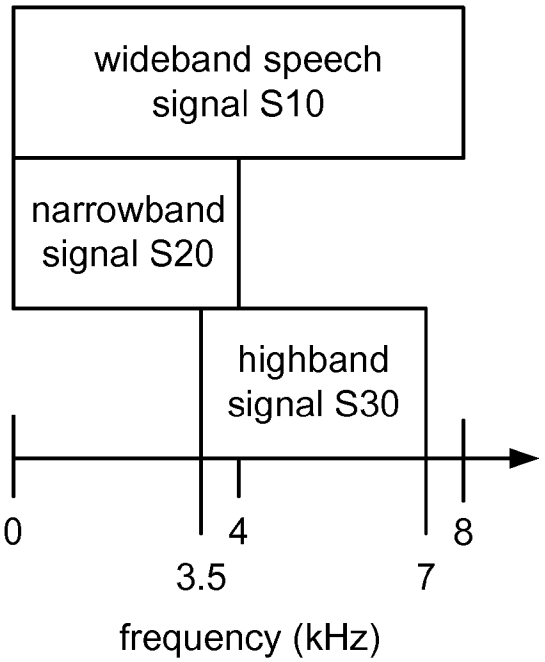
FIG. 3*b* shows bandwidth coverage of the low and high bands for another example of filter bank A110.
Figure 3A:
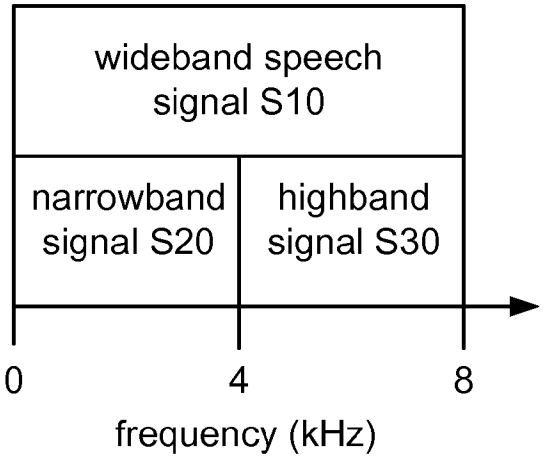
FIG. 3*a* shows bandwidth coverage of the low and high bands for one example of filter bank A110.

FIGS. 3*a* and 3*b* show relative bandwidths of wideband speech signal S10, narrowband signal S20, and highband signal S30 in two different implementation examples. In both of these particular examples, wideband speech signal S10 has a sampling rate of 16 kHz (representing frequency components within the range of 0 to 8 kHz), and narrowband signal S20 has a sampling rate of 8 kHz (representing frequency components within the range of 0 to 4 kHz), although such rates and ranges are not limits on the principles described herein, which may be applied to any other sampling rates and/or frequency ranges.

In the example of FIG. 3*a*, there is no significant overlap between the two subbands. A highband signal S30 as in this example may be downsampled to a sampling rate of 8 kHz. In the alternative example of FIG. 3*b*, the upper and lower subbands have an appreciable overlap, such that the region of 3.5 to 4 kHz is described by both subband signals. A highband signal S30 as in this example may be downsampled to a sampling rate of 7 kHz. Providing an overlap between subbands as in the example of FIG. 3*b* may allow a coding system to use a lowpass and/or a highpass filter having a smooth rolloff over the overlapped region and/or may increase the quality of reproduced frequency components in the overlapped region.

In a typical handset for telephonic communication, one or more of the transducers (i.e., the microphone and the earpiece or loudspeaker) lacks an appreciable response over the frequency range of 7-8 kHz. In the example of FIG. 3*b*, the portion of wideband speech signal S10 between 7 and 8 kHz is not included in the encoded signal. Other particular examples of highpass filter 130 have passbands of 3.5-7.5 kHz and 3.5-8 kHz.

A coder may be configured to produce a synthesized signal that is perceptually similar to the original signal but which actually differs significantly from the original signal. For example, a coder that derives the highband excitation from the narrowband residual as described herein may produce such a signal, as the actual highband residual may be completely absent from the decoded signal. In such cases, providing an overlap between subbands may support smooth blending of lowband and highband that may lead to fewer audible artifacts and/or a less noticeable transition from one band to the other.

The lowband and highband paths of filter banks A110 and B120 may be configured to have spectra that are completely unrelated apart from the overlapping of the two subbands. We define the overlap of the two subbands as the distance from the point at which the frequency response of the highband filter drops to −20 dB up to the point at which the frequency response of the lowband filter drops to −20 dB. In various examples of filter bank A110 and/or B120, this overlap ranges from around 200 Hz to around 1 kHz. The range of about 400 to about 600 Hz may represent a desirable tradeoff between coding efficiency and perceptual smoothness. In one particular example as mentioned above, the overlap is around 500 Hz.

It may be desirable to implement filter bank A110 and/or B120 to calculate subband signals as illustrated in FIGS. 3*a* and 3*b* in several stages. Additional description and figures relating to responses of elements of particular implementations of filter banks A110 and B120 may be found in the U.S. Pat. Appl. of Vos et al. entitled "SYSTEMS, METHODS, AND APPARATUS FOR SPEECH SIGNAL FILTERING," filed Apr. 3, 2006, Ser. No. 11/397,432 at FIGS. 3*a*, 3*b*, 4*c*, 4*d*, and 33-39*b* and the accompanying text (including paragraphs [00069]-[00087]), and this material is hereby incorporated by reference, in the United States and any other jurisdiction allowing incorporation by reference, for the purpose of providing additional disclosure relating to filter bank A110 and/or B120.

Highband signal S30 may include pulses of high energy ("bursts") that may be detrimental to encoding. A speech encoder such as wideband speech encoder A100 may be implemented to include a burst suppressor (e.g., as described in the U.S. Pat. Appl. of Vos et al. entitled "SYSTEMS, METHODS, AND APPARATUS FOR HIGHBAND BURST SUPPRESSION", Ser. No. 11/397,433, filed Apr. 3, 2006) to filter highband signal S30 prior to encoding (e.g., by highband encoder A200).

Figure 4A:
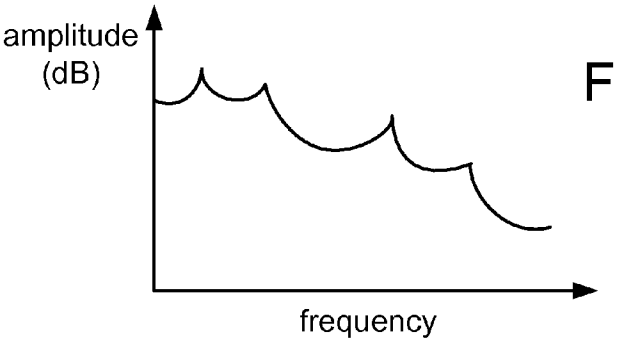
FIG. 4*a* shows an example of a plot of log amplitude vs. frequency for a speech signal.

Narrowband encoder A120 and highband encoder A200 are each typically implemented according to a source-filter model that encodes the input signal as (A) a set of parameters that describe a filter and (B) an excitation signal that drives the described filter to produce a synthesized reproduction of the input signal. FIG. 4*a* shows an example of a spectral envelope of a speech signal. The peaks that characterize this spectral envelope represent resonances of the vocal tract and are called formants. Most speech coders encode at least this coarse spectral structure as a set of parameters such as filter coefficients.

Figure 4B:
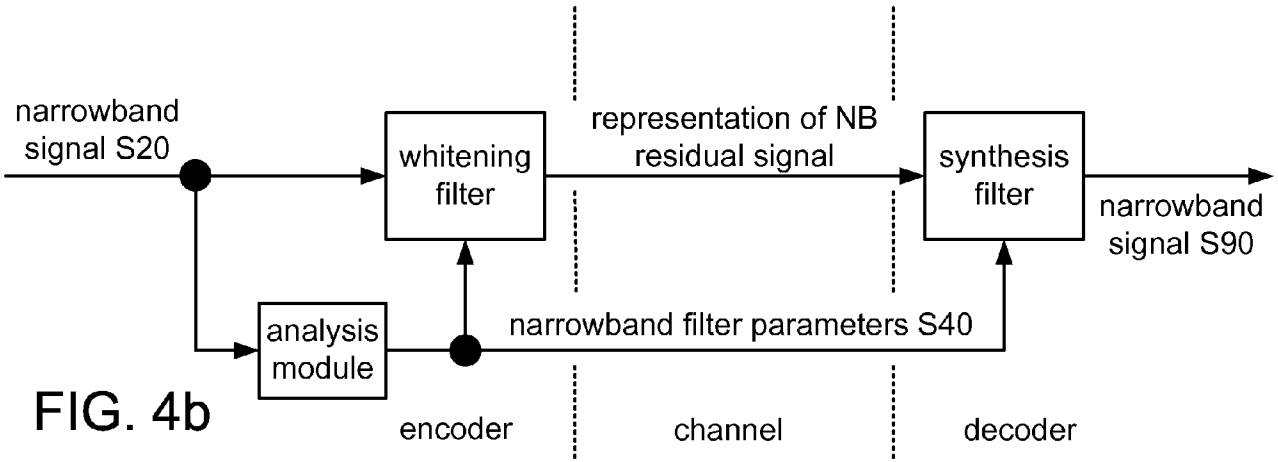
FIG. 4*b* shows a block diagram of a basic linear prediction coding system.

FIG. 4*b* shows an example of a basic source-filter arrangement as applied to coding of the spectral envelope of narrowband signal S20. An analysis module calculates a set of parameters that characterize a filter corresponding to the speech sound over a period of time (typically 20 milliseconds (msec)). A whitening filter (also called an analysis or prediction error filter) configured according to those filter parameters removes the spectral envelope to spectrally flatten the signal. The resulting whitened signal (also called a residual) has less energy and thus less variance and is easier to encode than the original speech signal. Errors resulting from coding of the residual signal may also be spread more evenly over the spectrum. The filter parameters and residual are typically quantized for efficient transmission over the channel. At the decoder, a synthesis filter configured according to the filter parameters is excited by a signal based on the residual to produce a synthesized version of the original speech sound. The synthesis filter is typically configured to have a transfer function that is the inverse of the transfer function of the whitening filter.

Figure 5:
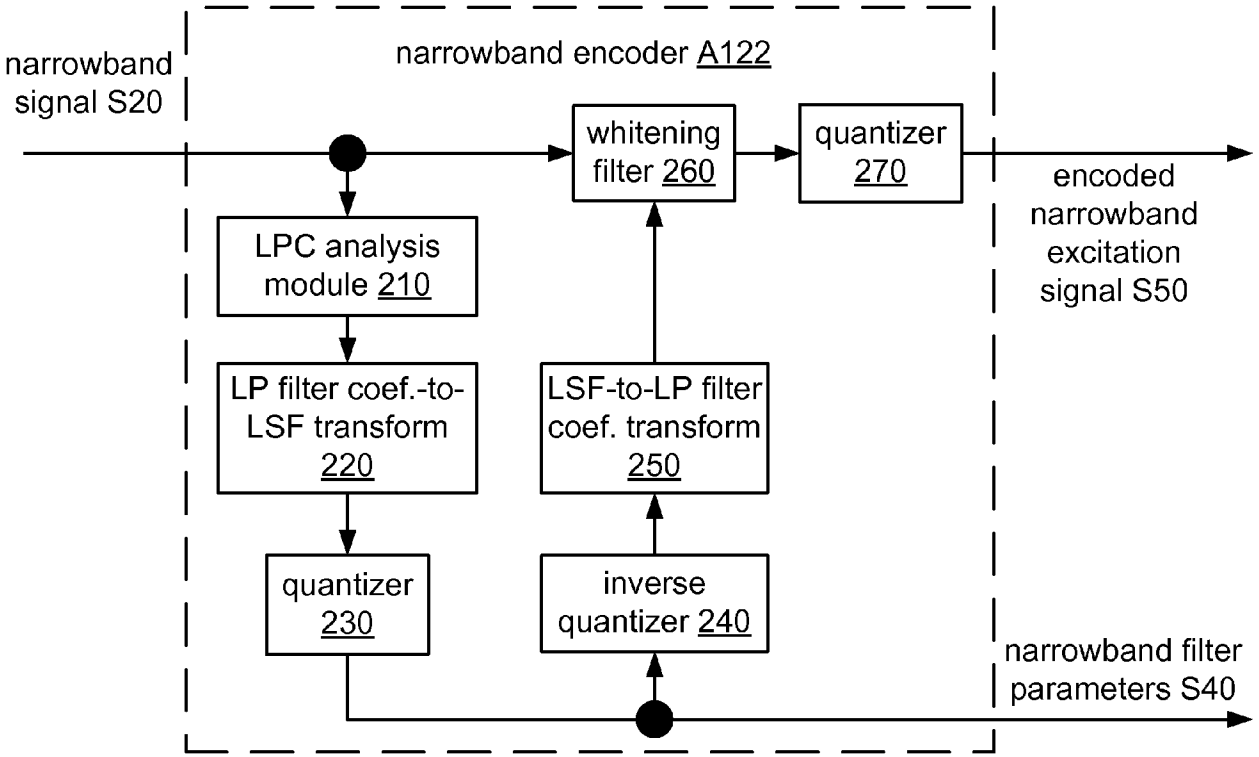
FIG. 5 shows a block diagram of an implementation A122 of narrowband encoder A120.

FIG. 5 shows a block diagram of a basic implementation A122 of narrowband encoder A120. In this example, a linear prediction coding (LPC) analysis module 210 encodes the spectral envelope of narrowband signal S20 as a set of linear prediction (LP) coefficients (e.g., coefficients of an all-pole filter 1/A(z)). The analysis module typically processes the input signal as a series of nonoverlapping frames, with a new set of coefficients being calculated for each frame. The frame period is generally a period over which the signal may be expected to be locally stationary; one common example is 20 milliseconds (equivalent to 160 samples at a sampling rate of 8 kHz). In one example, LPC analysis module 210 is configured to calculate a set of ten LP filter coefficients to characterize the formant structure of each 20-millisecond frame. It is also possible to implement the analysis module to process the input signal as a series of overlapping frames.

The analysis module may be configured to analyze the samples of each frame directly, or the samples may be weighted first according to a windowing function (for example, a Hamming window). The analysis may also be performed over a window that is larger than the frame, such as a 30-msec window. This window may be symmetric (e.g. 5-20-5, such that it includes the 5 milliseconds immediately before and after the 20-millisecond frame) or asymmetric (e.g. 10-20, such that it includes the last 10 milliseconds of the preceding frame). An LPC analysis module is typically configured to calculate the LP filter coefficients using a Levinson-Durbin recursion or the Leroux-Gueguen algorithm. In another implementation, the analysis module may be configured to calculate a set of cepstral coefficients for each frame instead of a set of LP filter coefficients.

The output rate of encoder A120 may be reduced significantly, with relatively little effect on reproduction quality, by quantizing the filter parameters. Linear prediction filter coefficients are difficult to quantize efficiently and are usually mapped into another representation, such as line spectral pairs (LSPs) or line spectral frequencies (LSFs), for quantization and/or entropy encoding. In the example of FIG. 5, LP filter coefficient-to-LSF transform 220 transforms the set of LP filter coefficients into a corresponding set of LSFs. Other one-to-one representations of LP filter coefficients include parcor coefficients; log-area-ratio values; immittance spectral pairs (ISPs); and immittance spectral frequencies (ISFs), which are used in the GSM (Global System for Mobile Communications) AMR-WB (Adaptive Multi-rate-Wideband) codec. Typically a transform between a set of LP filter coefficients and a corresponding set of LSFs is reversible, but configurations also include implementations of encoder A120 in which the transform is not reversible without error.

Quantizer 230 is configured to quantize the set of narrowband LSFs (or other coefficient representation), and narrowband encoder A122 is configured to output the result of this quantization as the narrowband filter parameters S40. Such a quantizer typically includes a vector quantizer that encodes the input vector as an index to a corresponding vector entry in a table or codebook.

Figure 9:
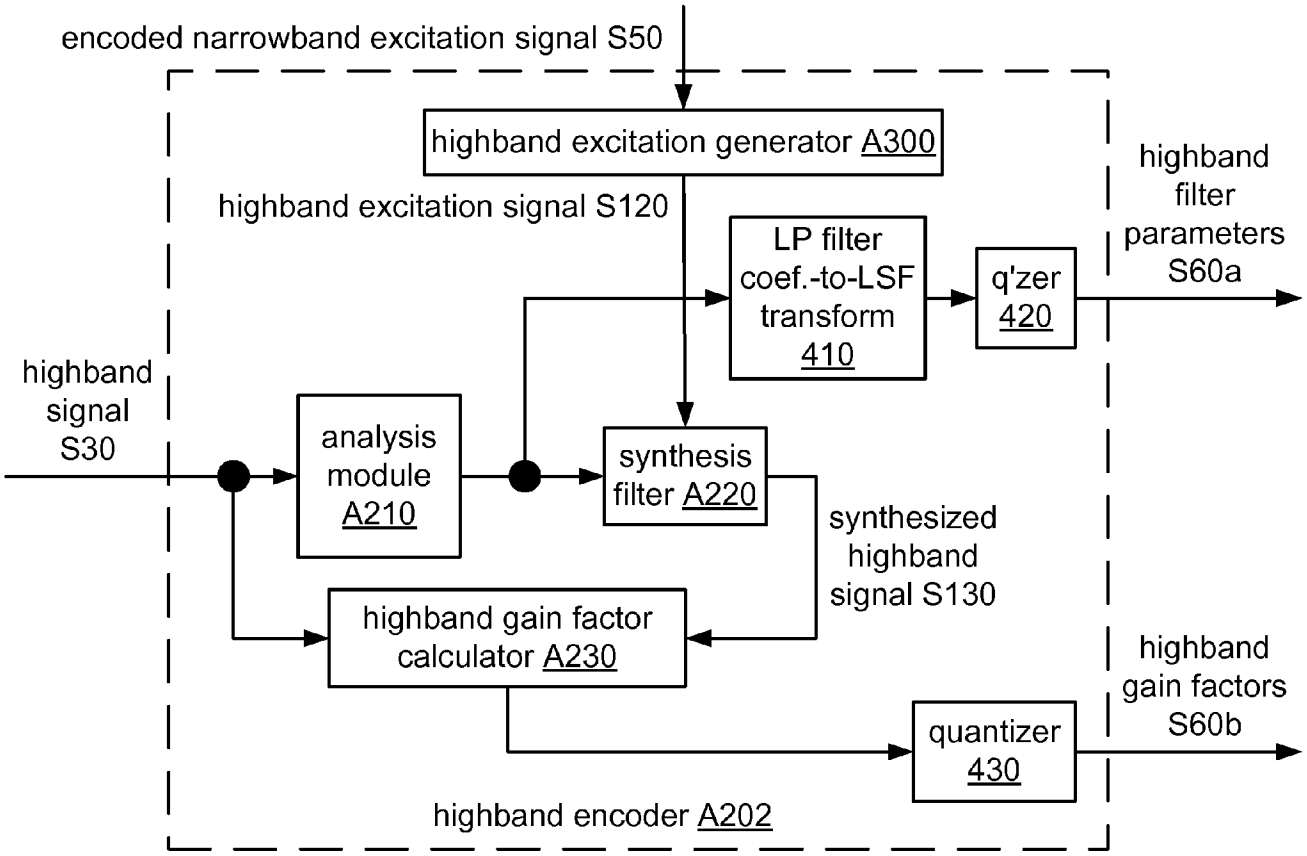
FIG. 9 shows a block diagram of an implementation A202 of highband encoder A200.

FIG. 9 shows a block diagram of an implementation A202 of highband encoder A200. Analysis module A210, transform 410, and quantizer 420 of highband encoder A202 may be implemented according to the descriptions of the corresponding elements of narrowband encoder A122 as described above (i.e., LPC analysis module 210, transform 220, and quantizer 230, respectively), although it may be desirable to use a lower-order LPC analysis for the highband. It is even possible for these narrowband and highband encoder elements to be implemented using the same structures (e.g., arrays of gates) and/or sets of instructions (e.g., lines of code) at different times. As described below, the operations of narrowband encoder A120 and highband encoder A200 differ with respect to processing of the residual signal.

As seen in FIG. 5, narrowband encoder A122 also generates a residual signal by passing narrowband signal S20 through a whitening filter 260 (also called an analysis or prediction error filter) that is configured according to the set of filter coefficients. In this particular example, whitening filter 260 is implemented as a FIR filter, although IIR implementations may also be used. This residual signal will typically contain perceptually important information of the speech frame, such as long-term structure relating to pitch, that is not represented in narrowband filter parameters S40. Quantizer 270 is configured to calculate a quantized representation of this residual signal for output as encoded narrowband excitation signal S50. Such a quantizer typically includes a vector quantizer that encodes the input vector as an index to a corresponding vector entry in a table or codebook. Alternatively, such a quantizer may be configured to send one or more parameters from which the vector may be generated dynamically at the decoder, rather than retrieved from storage, as in a sparse codebook method. Such a method is used in coding schemes such as algebraic CELP (codebook excitation linear prediction) and codecs such as 3GPP2 (Third Generation Partnership 2) EVRC (Enhanced Variable Rate Codec).

It is desirable for narrowband encoder A120 to generate the encoded narrowband excitation signal according to the same filter parameter values that will be available to the corresponding narrowband decoder. In this manner, the resulting encoded narrowband excitation signal may already account to some extent for nonidealities in those parameter values, such as quantization error. Accordingly, it is desirable to configure the whitening filter using the same coefficient values that will be available at the decoder. In the basic example of encoder A122 as shown in FIG. 5, inverse quantizer 240 dequantizes narrowband coding parameters S40, LSF-to-LP filter coefficient transform 250 maps the resulting values back to a corresponding set of LP filter coefficients, and this set of coefficients is used to configure whitening filter 260 to generate the residual signal that is quantized by quantizer 270.

Some implementations of narrowband encoder A120 are configured to calculate encoded narrowband excitation signal S50 by identifying one among a set of codebook vectors that best matches the residual signal. It is noted, however, that narrowband encoder A120 may also be implemented to calculate a quantized representation of the residual signal without actually generating the residual signal. For example, narrowband encoder A120 may be configured to use a number of codebook vectors to generate corresponding synthesized signals (e.g., according to a current set of filter parameters), and to select the codebook vector associated with the generated signal that best matches the original narrowband signal S20 in a perceptually weighted domain.

Figure 7A:
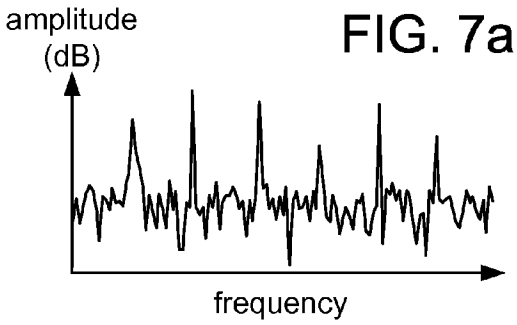
FIG. 7*a* shows an example of a plot of log amplitude vs. frequency for a residual signal for voiced speech.
Figure 7B:
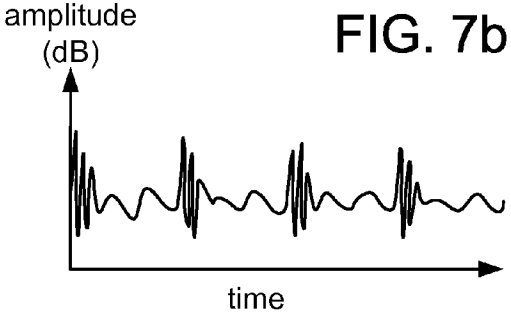
FIG. 7*b* shows an example of a plot of log amplitude vs. time for a residual signal for voiced speech.

Even after the whitening filter has removed the coarse spectral envelope from narrowband signal S20, a considerable amount of fine harmonic structure may remain, especially for voiced speech. FIG. 7*a* shows a spectral plot of one example of a residual signal, as may be produced by a whitening filter, for a voiced signal such as a vowel. The periodic structure visible in this example is related to pitch, and different voiced sounds spoken by the same speaker may have different formant structures but similar pitch structures. FIG. 7*b* shows a time-domain plot of an example of such a residual signal that shows a sequence of pitch pulses in time.

Figure 8:
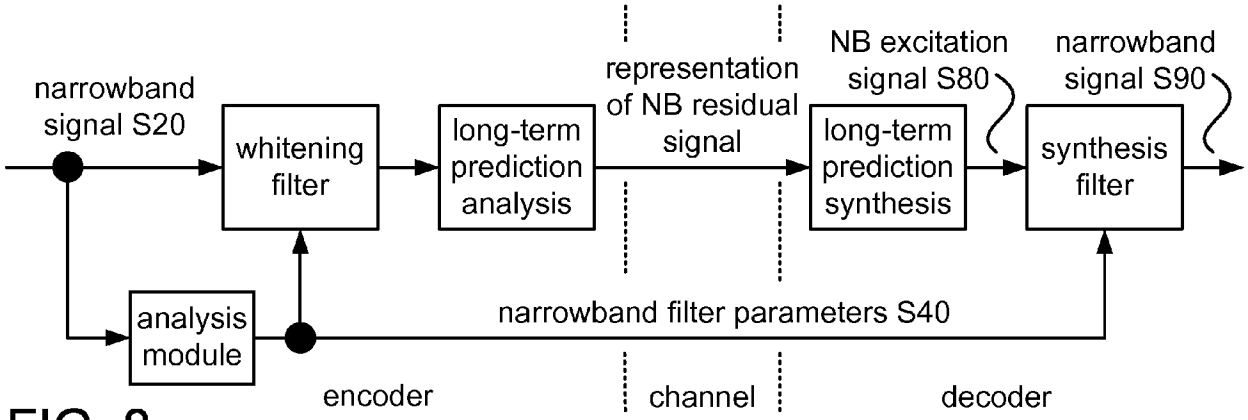
FIG. 8 shows a block diagram of a basic linear prediction coding system that also performs long-term prediction.

Narrowband encoder A120 may include one or more modules configured to encode the long-term harmonic structure of narrowband signal S20. As shown in FIG. 8, one typical CELP paradigm that may be used includes an open-loop LPC analysis module, which encodes the short-term characteristics or coarse spectral envelope, followed by a closed-loop long-term prediction analysis stage, which encodes the fine pitch or harmonic structure. The short-term characteristics are encoded as filter coefficients, and the long-term characteristics are encoded as values for parameters such as pitch lag and pitch gain. For example, narrowband encoder A120 may be configured to output encoded narrowband excitation signal S50 in a form that includes one or more codebook indices (e.g., a fixed codebook index and an adaptive codebook index) and corresponding gain values. Calculation of this quantized representation of the narrowband residual signal (e.g., by quantizer 270) may include selecting such indices and calculating such values. Encoding of the pitch structure may also include interpolation of a pitch prototype waveform, which operation may include calculating a difference between successive pitch pulses. Modeling of the long-term structure may be disabled for frames corresponding to unvoiced speech, which is typically noise-like and unstructured.

Figure 6:
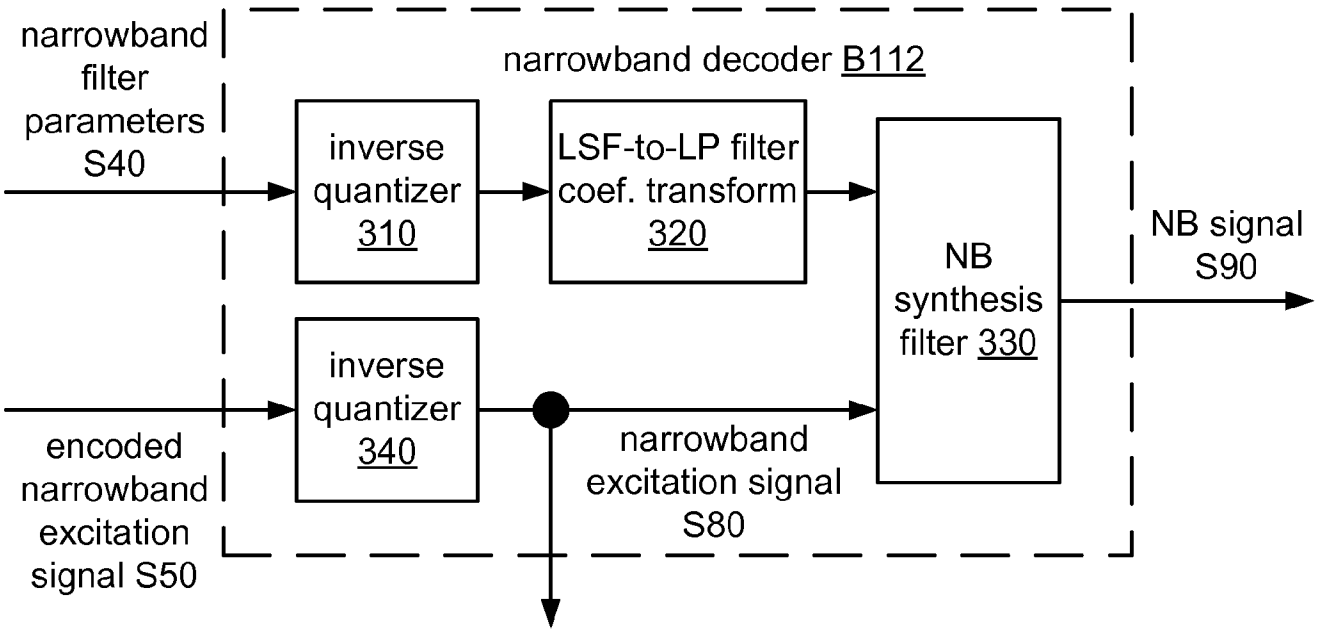
FIG. 6 shows a block diagram of an implementation B112 of narrowband decoder B110.

FIG. 6 shows a block diagram of an implementation B112 of narrowband decoder B110. Inverse quantizer 310 dequantizes narrowband filter parameters S40 (in this case, to a set of LSFs), and LSF-to-LP filter coefficient transform 320 transforms the LSFs into a set of filter coefficients (for example, as described above with reference to inverse quantizer 240 and transform 250 of narrowband encoder Al22). Inverse quantizer 340 dequantizes encoded narrowband excitation signal S50 to produce a narrowband excitation signal S80. Based on the filter coefficients and narrowband excitation signal S80, narrowband synthesis filter 330 synthesizes narrowband signal S90. In other words, narrowband synthesis filter 330 is configured to spectrally shape narrowband excitation signal S80 according to the dequantized filter coefficients to produce narrowband signal S90. Narrowband decoder B112 also provides narrowband excitation signal S80 to highband encoder A200, which uses it to derive the highband excitation signal S120 as described herein. In some implementations as described below, narrowband decoder B110 may be configured to provide additional information to highband decoder B200 that relates to the narrowband signal, such as spectral tilt, pitch gain and lag, and speech mode.

The system of narrowband encoder A122 and narrowband decoder B112 is a basic example of an analysis-by-synthesis speech codec. Codebook excitation linear prediction (CELP) coding is one popular family of analysis-by-synthesis coding, and implementations of such coders may perform waveform encoding of the residual, including such operations as selection of entries from fixed and adaptive codebooks, error minimization operations, and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse CELP (MPE), and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10), which uses residual excited linear prediction (RELP); the GSM enhanced full rate codec (ETSI-GSM 06.60); the ITU (International Telecommunication Union) standard 11.8 kb/s G.729 Annex E coder; the IS (Interim Standard)-641 codecs for IS-136 (a time-division multiple access scheme); the GSM adaptive multi-rate (GSM-AMR) codecs; and the 4GV™ (Fourth-Generation Vocoder™) codec (QUALCOMM Incorporated, San Diego, Calif.). Narrowband encoder A120 and corresponding decoder B110 may be implemented according to any of these technologies, or any other speech coding technology (whether known or to be developed) that represents a speech signal as (A) a set of parameters that describe a filter and (B) an excitation signal used to drive the described filter to reproduce the speech signal.

Highband encoder A200 is configured to encode highband signal S30 according to a source-filter model. For example, highband encoder A200 is typically configured to perform an LPC analysis of highband signal S30 to obtain a set of filter parameters that describe a spectral envelope of the signal. As on the narrowband side, the source signal used to excite this filter may be derived from or otherwise based on the residual of the LPC analysis. However, highband signal S30 is typically less perceptually significant than narrowband signal S20, and it would be expensive for the encoded speech signal to include two excitation signals. To reduce the bit rate needed to transfer the encoded wideband speech signal, it may be desirable to use a modeled excitation signal instead for the highband. For example, the excitation for the highband filter may be based on encoded narrowband excitation signal S50.

FIG. 9 shows a block diagram of an implementation A202 of highband encoder A200 that is configured to produce a stream of highband coding parameters S60 including highband filter parameters S60*a* and highband gain factors S60*b*. Highband excitation generator A300 derives a highband excitation signal S120 from encoded narrowband excitation signal S50. Analysis module A210 produces a set of parameter values that characterize the spectral envelope of highband signal S30. In this particular example, analysis module A210 is configured to perform LPC analysis to produce a set of LP filter coefficients for each frame of highband signal S30. Linear prediction filter coefficient-to-LSF transform 410 transforms the set of LP filter coefficients into a corresponding set of LSFs. As noted above with reference to analysis module 210 and transform 220, analysis module A210 and/or transform 410 may be configured to use other coefficient sets (e.g., cepstral coefficients) and/or coefficient representations (e.g., ISPs).

Quantizer 420 is configured to quantize the set of highband LSFs (or other coefficient representation, such as ISPs), and highband encoder A202 is configured to output the result of this quantization as the highband filter parameters S60*a*. Such a quantizer typically includes a vector quantizer that encodes the input vector as an index to a corresponding vector entry in a table or codebook.

Highband encoder A202 also includes a synthesis filter A220 configured to produce a synthesized highband signal S130 according to highband excitation signal S120 and the encoded spectral envelope (e.g., the set of LP filter coefficients) produced by analysis module A210. Synthesis filter A220 is typically implemented as an TTR filter, although FIR implementations may also be used. In a particular example, synthesis filter A220 is implemented as a sixth-order linear autoregressive filter.

In an implementation of wideband speech encoder A100 according to a paradigm as shown in FIG. 8, highband encoder A200 may be configured to receive the narrowband excitation signal as produced by the short-term analysis or whitening filter. In other words, narrowband encoder A120 may be configured to output the narrowband excitation signal to highband encoder A200 before encoding the long-term structure. It is desirable, however, for highband encoder A200 to receive from the narrowband channel the same coding information that will be received by highband decoder B200, such that the coding parameters produced by highband encoder A200 may already account to some extent for nonidealities in that information. Thus it may be preferable for highband encoder A200 to reconstruct narrowband excitation signal S80 from the same parametrized and/or quantized encoded narrowband excitation signal S50 to be output by wideband speech encoder A100. One potential advantage of this approach is more accurate calculation of the highband gain factors S60*b* described below.

Highband gain factor calculator A230 calculates one or more differences between the levels of the original highband signal S30 and synthesized highband signal S130 to specify a gain envelope for the frame. Quantizer 430, which may be implemented as a vector quantizer that encodes the input vector as an index to a corresponding vector entry in a table or codebook, quantizes the value or values specifying the gain envelope, and highband encoder A202 is configured to output the result of this quantization as highband gain factors S60*b*.

One or more of the quantizers of the elements described herein (e.g., quantizer 230, 420, or 430) may be configured to perform classified vector quantization. For example, such a quantizer may be configured to select one of a set of codebooks based on information that has already been coded within the same frame in the narrowband channel and/or in the highband channel. Such a technique typically provides increased coding efficiency at the expense of additional codebook storage.

In an implementation of highband encoder A200 as shown in FIG. 9, synthesis filter A220 is arranged to receive the filter coefficients from analysis module A210. An alternative implementation of highband encoder A202 includes an inverse quantizer and inverse transform configured to decode the filter coefficients from highband filter parameters S60*a*, and in this case synthesis filter A220 is arranged to receive the decoded filter coefficients instead. Such an alternative arrangement may support more accurate calculation of the gain envelope by highband gain calculator A230.

In one particular example, analysis module A210 and highband gain calculator A230 output a set of six LSFs and a set of five gain values per frame, respectively, such that a wideband extension of the narrowband signal S20 may be achieved with only eleven additional values per frame. In a further example, another gain value is added for each frame, to provide a wideband extension with only twelve additional values per frame. The ear tends to be less sensitive to frequency errors at high frequencies, such that highband coding at a low LPC order may produce a signal having a comparable perceptual quality to narrowband coding at a higher LPC order. A typical implementation of highband encoder A200 may be configured to output 8 to 12 bits per frame for high-quality reconstruction of the spectral envelope and another 8 to 12 bits per frame for high-quality reconstruction of the temporal envelope. In another particular example, analysis module A210 outputs a set of eight LSFs per frame.

Some implementations of highband encoder A200 are configured to produce highband excitation signal S120 by generating a random noise signal having highband frequency components and amplitude-modulating the noise signal according to the time-domain envelope of narrowband signal S20, narrowband excitation signal S80, or highband signal S30. In such case, it may be desirable for the state of the noise generator to be a deterministic function of other information in the encoded speech signal (e.g., information in the same frame, such as narrowband filter parameters S40 or a portion thereof, and/or encoded narrowband excitation signal S50 or a portion thereof), so that corresponding noise generators in highband excitation generators of the encoded and decoder may have the same states. While a noise-based method may produce adequate results for unvoiced sounds, however, it may not be desirable for voiced sounds, whose residuals are usually harmonic and consequently have some periodic structure.

Highband excitation generator A300 is configured to obtain narrowband excitation signal S80 (e.g., by dequantizing encoded narrowband excitation signal S50) and to generate highband excitation signal S120 based on narrowband excitation signal S80. For example, highband excitation generator A300 may be implemented to perform one or more techniques such as harmonic bandwidth extension, spectral folding, spectral translation, and/or harmonic synthesis using non-linear processing of narrowband excitation signal S80. In one particular example, highband excitation generator A300 is configured to generate highband excitation signal S120 by nonlinear bandwidth extension of narrowband excitation signal S80 combined with adaptive mixing of the extended signal with a modulated noise signal. Highband excitation generator A300 may also be configured to perform anti-sparseness filtering of the extended and/or mixed signal.

Additional description and figures relating to highband excitation generator A300 and generation of highband excitation signal S120 may be found in Ser. No. 11/397,870, entitled "SYSTEMS, METHODS, AND APPARATUS FOR HIGHBAND EXCITATION GENERATION" (Vos et al.), filed Apr. 3, 2006, at FIGS. 11-20 and the accompanying text (including paragraphs [000112]-[000146] and [000156]), and this material is hereby incorporated by reference, in the United States and any other jurisdiction allowing incorporation by reference, for the purpose of providing additional disclosure relating to highband excitation generator A300 and/or to the generation of an excitation signal for one subband from an encoded excitation signal for another subband.

Figure 10:
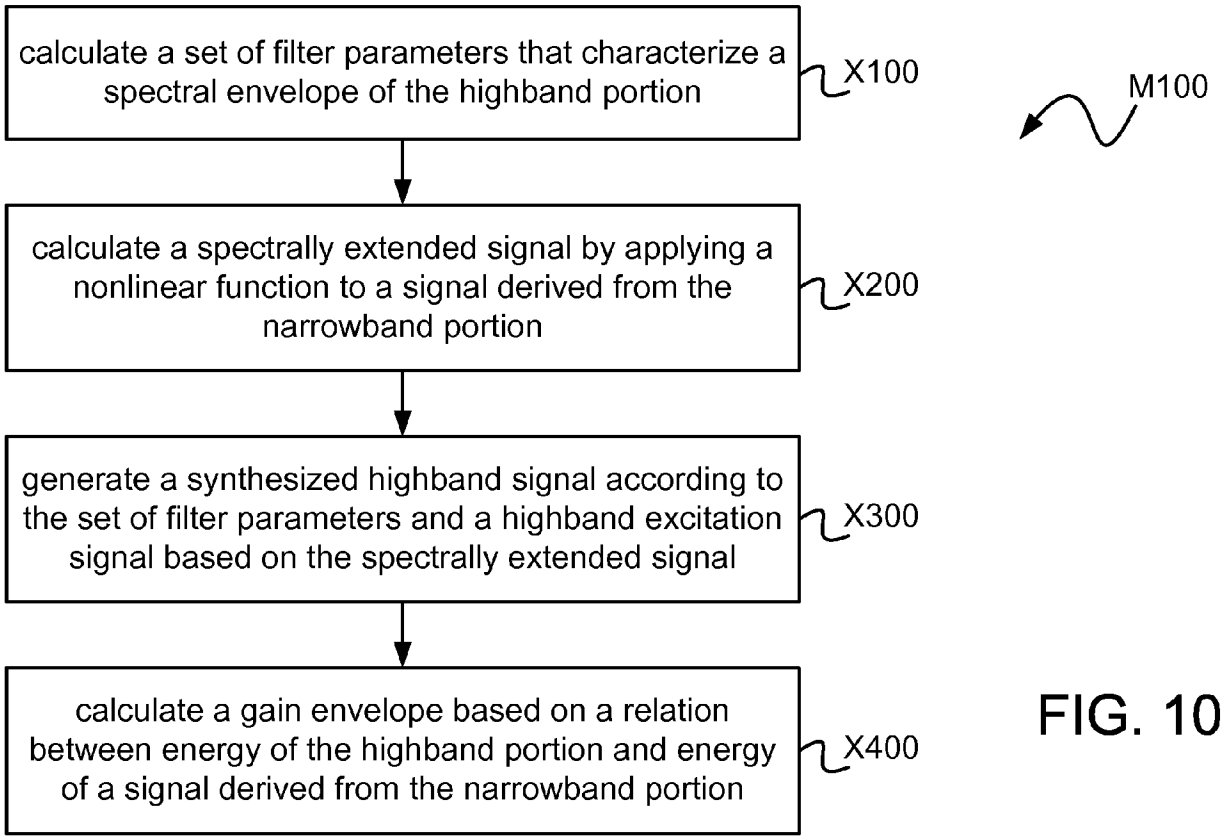
FIG. 10 shows a flowchart for a method M10 of encoding a highband portion.

FIG. 10 shows a flowchart of a method M10 of encoding a highband portion of a speech signal having a narrowband portion and the highband portion. Task X100 calculates a set of filter parameters that characterize a spectral envelope of the highband portion. Task X200 calculates a spectrally extended signal by applying a nonlinear function to a signal derived from the narrowband portion. Task X300 generates a synthesized highband signal according to (A) the set of filter parameters and (B) a highband excitation signal based on the spectrally extended signal. Task X400 calculates a gain envelope based on a relation between (C) energy of the highband portion and (D) energy of a signal derived from the narrowband portion.

It will typically be desirable for the temporal characteristics of a decoded signal to resemble those of the original signal it represents. Moreover, for a system in which different subbands are separately encoded, it may be desirable for the relative temporal characteristics of subbands in the decoded signal to resemble the relative temporal characteristics of those subbands in the original signal. For accurate reproduction of the encoded speech signal, it may be desirable for the ratio between the levels of the highband and narrowband portions of the synthesized wideband speech signal S100 to be similar to that in the original wideband speech signal S10. Highband encoder A200 may be configured to include information in the encoded speech signal that describes or is otherwise based on a temporal envelope of the original highband signal. For a case in which the highband excitation signal is based on information from another subband, such as encoded narrowband excitation signal S50, it may be desirable in particular for the encoded parameters to include information describing a difference between the temporal envelopes of the synthesized highband signal and the original highband signal.

In addition to information relating to the spectral envelope of highband signal S30 (i.e., as described by the LPC coefficients or similar parameter values), it may be desirable for the encoded parameters of a wideband signal to include temporal information of highband signal S30. In addition to a spectral envelope as represented by highband coding parameters S60*a*, for example, highband encoder A200 may be configured to characterize highband signal S30 by specifying a temporal or gain envelope. As shown in FIG. 9, highband encoder A202 includes a highband gain factor calculator A230 that is configured and arranged to calculate one or more gain factors according to a relation between highband signal S30 and synthesized highband signal S130, such as a difference or ratio between the energies of the two signals over a frame or some portion thereof. In other implementations of highband encoder A202, highband gain calculator A230 may be likewise configured but arranged instead to calculate the gain envelope according to such a time-varying relation between highband signal S30 and narrowband excitation signal S80 or highband excitation signal S120.

The temporal envelopes of narrowband excitation signal S80 and highband signal S30 are likely to be similar. Therefore, a gain envelope that is based on a relation between highband signal S30 and narrowband excitation signal S80 (or a signal derived therefrom, such as highband excitation signal S120 or synthesized highband signal S130) will generally be better suited for encoding than a gain envelope based only on highband signal S30.

Highband encoder A202 includes a highband gain factor calculator A230 configured to calculate one or more gain factors for each frame of highband signal S30, where each gain factor is based on a relation between temporal envelopes of corresponding portions of synthesized highband signal S130 and highband signal S30. For example, highband gain factor calculator A230 may be configured to calculate each gain factor as a ratio between amplitude envelopes of the signals or as a ratio between energy envelopes of the signals. In one typical implementation, highband encoder A202 is configured to output a quantized index of eight to twelve bits that specifies five gain factors for each frame (e.g., one for each of five consecutive subframes). In a further implementation, highband encoder A202 is configured to output an additional quantized index that specifies a frame-level gain factor for each frame.

A gain factor may be calculated as a normalization factor, such as a ratio R between a measure of energy of the original signal and a measure of energy of the synthesized signal. The ratio R may be expressed as a linear value or as a logarithmic value (e.g., on a decibel scale). Highband gain factor calculator A230 may be configured to calculate such a normalization factor for each frame. Alternatively or additionally, highband gain factor calculator A230 may be configured to calculate a series of gain factors for each of a number of subframes of each frame. In one example, highband gain factor calculator A230 is configured to calculate the energy of each frame (and/or subframe) as a square root of a sum of squares.

Figure 11:
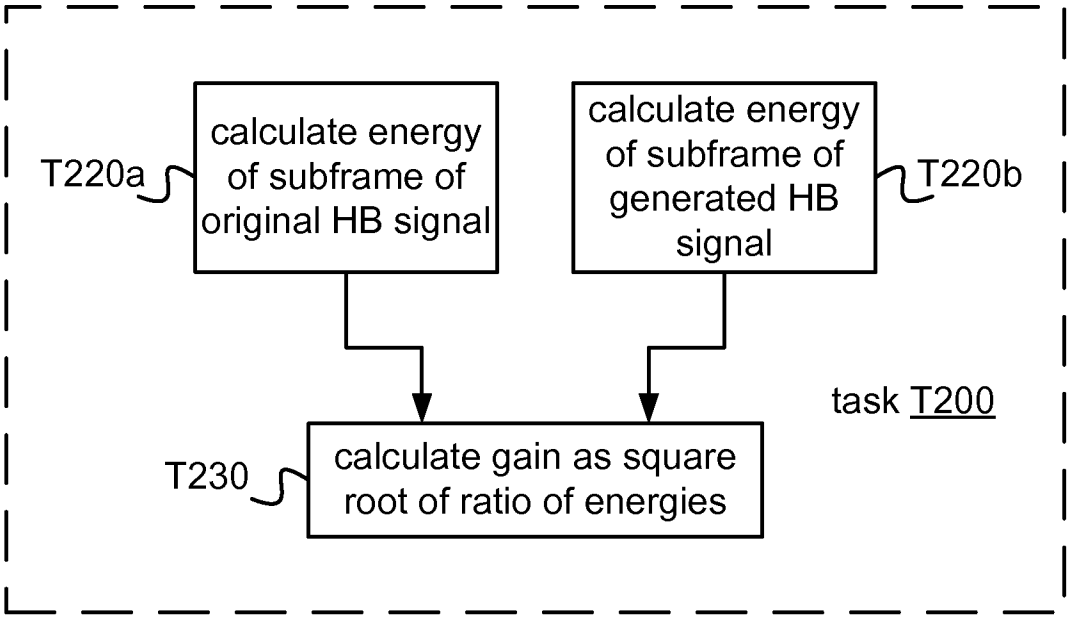
FIG. 11 shows a flowchart for a gain calculation task T200.

Highband gain factor calculator A230 may be configured to perform gain factor calculation as a task that includes one or more series of subtasks. FIG. 11 shows a flowchart of an example T200 of such a task that calculates a gain value for a corresponding portion of the encoded highband signal (e.g., a frame or subframe) according to the relative energies of corresponding portions of highband signal S30 and synthesized highband signal S130. Tasks 220*a* and 220*b* calculate the energies of the corresponding portions of the respective signals. For example, tasks 220*a* and 220*b* may be configured to calculate the energy as a sum of the squares of the samples of the respective portions. Task T230 calculates a gain factor as the square root of the ratio of those energies. In this example, task T230 calculates a gain factor for the portion as the square root of the ratio of the energy of highband signal S30 over the portion to the energy of synthesized highband signal S130 over the portion.

Figure 12:
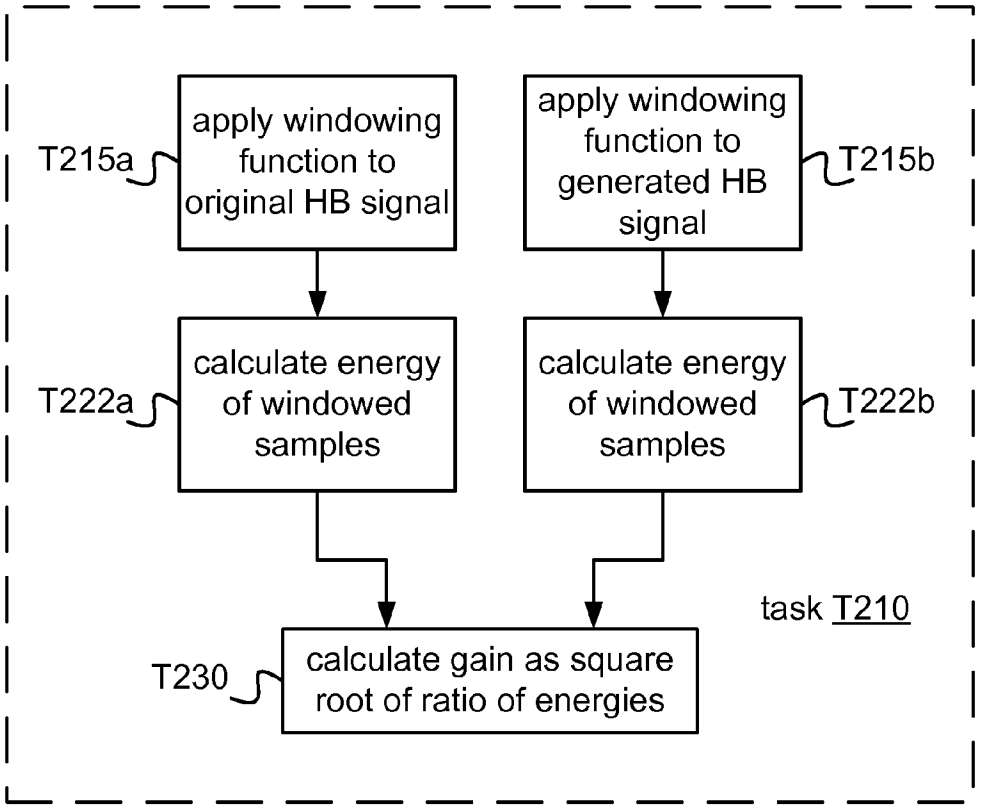
FIG. 12 shows a flowchart for an implementation T210 of gain calculation task T200.

It may be desirable for highband gain factor calculator A230 to be configured to calculate the energies according to a windowing function. FIG. 12 shows a flowchart of such an implementation T210 of gain factor calculation task T200. Task T215*a* applies a windowing function to highband signal S30, and task T215*b* applies the same windowing function to synthesized highband signal S130. Implementations 222*a* and 222*b* of tasks 220*a* and 220*b* calculate the energies of the respective windows, and task T230 calculates a gain factor for the portion as the square root of the ratio of the energies.

Figure 13A:
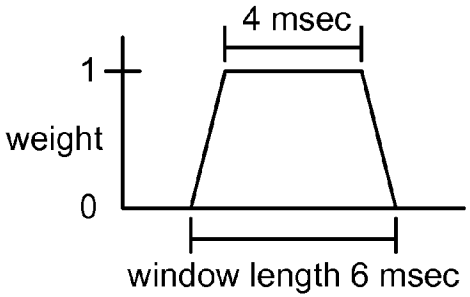
FIG. 13*a* shows a diagram of a windowing function.
Figure 13B:
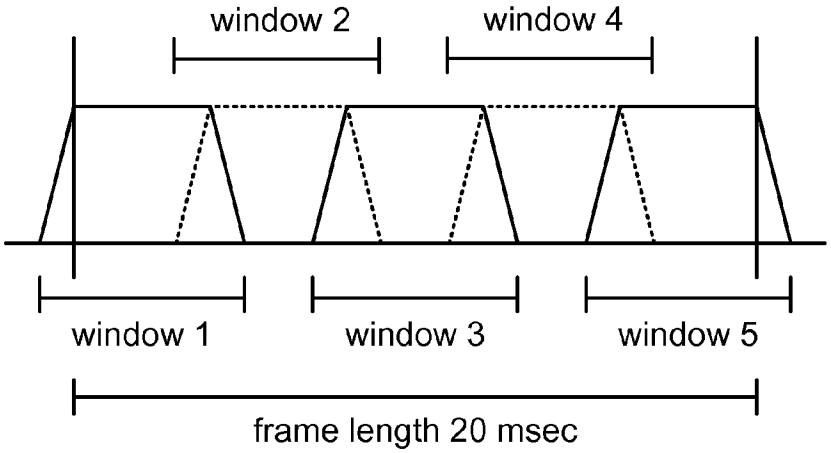
FIG. 13*b* shows an application of a windowing function as shown in FIG. 13*a* to subframes of a speech signal.

In calculating a gain factor for a frame, it may be desirable to apply a windowing function that overlaps adjacent frames. In calculating a gain factor for a subframe, it may be desirable to apply a windowing function that overlaps adjacent subframes. For example, a windowing function that produces gain factors which may be applied in an overlap-add fashion may help to reduce or avoid discontinuity between subframes. In one example, highband gain factor calculator A230 is configured to apply a trapezoidal windowing function as shown in FIG. 13*a*, in which the window overlaps each of the two adjacent subframes by one millisecond. FIG. 13*b* shows an application of this windowing function to each of the five subframes of a 20-millisecond frame. Other implementations of highband gain factor calculator A230 may be configured to apply windowing functions having different overlap periods and/or different window shapes (e.g., rectangular, Hamming) that may be symmetrical or asymmetrical. It is also possible for an implementation of highband gain factor calculator A230 to be configured to apply different windowing functions to different subframes within a frame and/or for a frame to include subframes of different lengths. In one particular implementation, highband gain factor calculator A230 is configured to calculate subframe gain factors using a trapezoidal windowing function as shown in FIGS. 13*a* and 13*b* and is also configured to calculate a frame-level gain factor without using a windowing function.

Without limitation, the following values are presented as examples for particular implementations. A 20-msec frame is assumed for these cases, although any other duration may be used. For a highband signal sampled at 7 kHz, each frame has 140 samples. If such a frame is divided into five subframes of equal length, each subframe will have 28 samples, and the window as shown in FIG. 13*a* will be 42 samples wide. For a highband signal sampled at 8 kHz, each frame has 160 samples. If such frame is divided into five subframes of equal length, each subframe will have 32 samples, and the window as shown in FIG. 13*a* will be 48 samples wide. In other implementations, subframes of any width may be used, and it is even possible for an implementation of highband gain calculator A230 to be configured to produce a different gain factor for each sample of a frame.

Figure 14A:
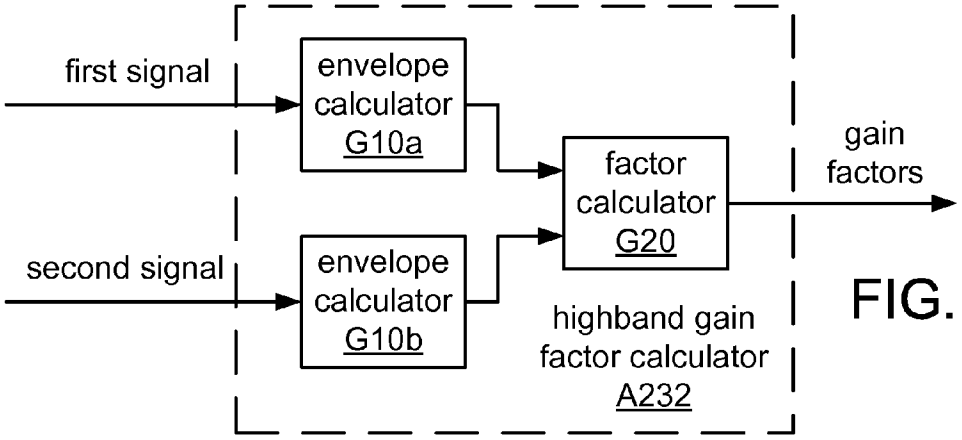
FIG. 14*a* shows a block diagram of an implementation A232 of highband gain factor calculator A230.

As noted above, highband encoder A202 may include a highband gain factor calculator A230 that is configured to calculate a series of gain factors according to a time-varying relation between highband signal S30 and a signal based on narrowband signal S20 (such as narrowband excitation signal S80, highband excitation signal S120, or synthesized highband signal S130). FIG. 14*a* shows a block diagram of an implementation A232 of highband gain factor calculator A230. Highband gain factor calculator A232 includes an implementation G10*a* of envelope calculator G10 that is arranged to calculate an envelope of a first signal, and an implementation G10*b* of envelope calculator G10 that is arranged to calculate an envelope of a second signal. Envelope calculators G10*a* and G10*b* may be identical or may be instances of different implementations of envelope calculator G10. In some cases, envelope calculators G10*a* and G10*b* may be implemented as the same structure (e.g., array of gates) and/or set of instructions (e.g., lines of code) configured to process different signals at different times.

Envelope calculators G10*a* and G10*b* may each be configured to calculate an amplitude envelope (e.g., according to an absolute value function) or an energy envelope (e.g., according to a squaring function). Typically, each envelope calculator G10*a*, G10*b* is configured to calculate an envelope that is subsampled with respect to the input signal (e.g., an envelope having one value for each frame or subframe of the input signal). As described above with reference to, e.g., FIGS. 11-13*b*, envelope calculator G10*a* and/or G10*b* may be configured to calculate the envelope according to a windowing function, which may be arranged to overlap adjacent frames and/or subframes.

Factor calculator G20 is configured to calculate a series of gain factors according to a time-varying relation between the two envelopes over time. In one example as described above, factor calculator G20 calculates each gain factor as the square root of the ratio of the envelopes over a corresponding subframe. Alternatively, factor calculator G20 may be configured to calculate each gain factor based on a distance between the envelopes, such as a difference or a signed squared difference between the envelopes during a corresponding subframe. It may be desirable to configure factor calculator G20 to output the calculated values of the gain factors in a decibel or other logarithmically scaled form. For example, factor calculator G20 may be configured to calculate a logarithm of the ratio of two energy values as the difference of the logarithms of the energy values.

Figure 14B:
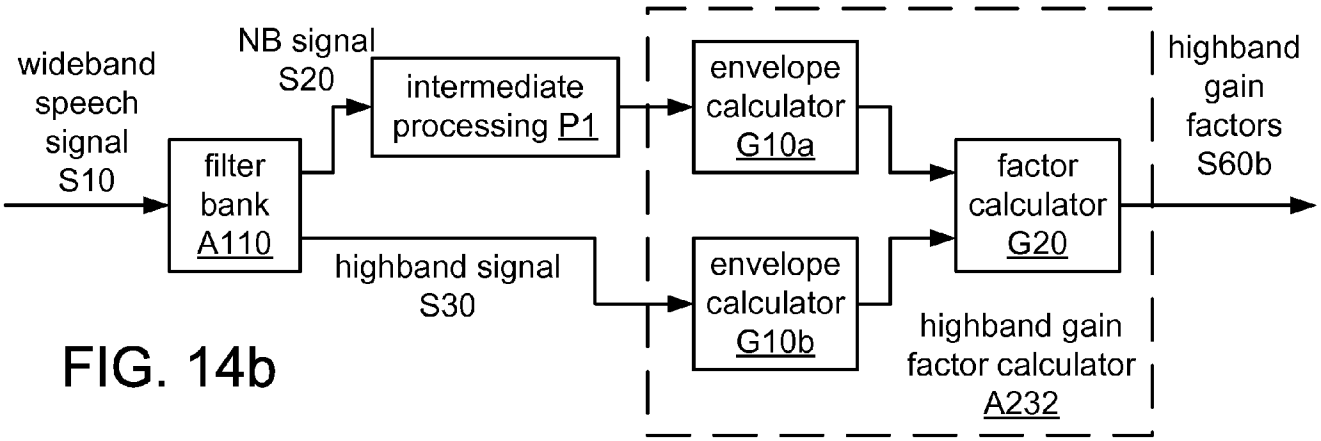
FIG. 14*b* shows a block diagram of an arrangement including highband gain factor calculator A232.

FIG. 14*b* shows a block diagram of a generalized arrangement including highband gain factor calculator A232 in which envelope calculator G10*a* is arranged to calculate an envelope of a signal based on narrowband signal S20, envelope calculator G10*b* is arranged to calculate an envelope of highband signal S30, and factor calculator G20 is configured to output highband gain factors S60*b* (e.g., to quantizer 430). In this example, envelope calculator G10*a* is arranged to calculate an envelope of a signal received from intermediate processing P1, which may include structures and/or instructions as described herein that are configured to perform calculation of narrowband excitation signal S80, generation of highband excitation signal S120, and/or synthesis of highband signal S130. For convenience, it is assumed that envelope calculator G10*a* is arranged to calculate an envelope of synthesized highband signal S130, although implementations in which envelope calculator G10*a* is arranged to calculate an envelope of narrowband excitation signal S80 or highband excitation signal S120 instead are expressly contemplated and hereby disclosed.

Figure 15:
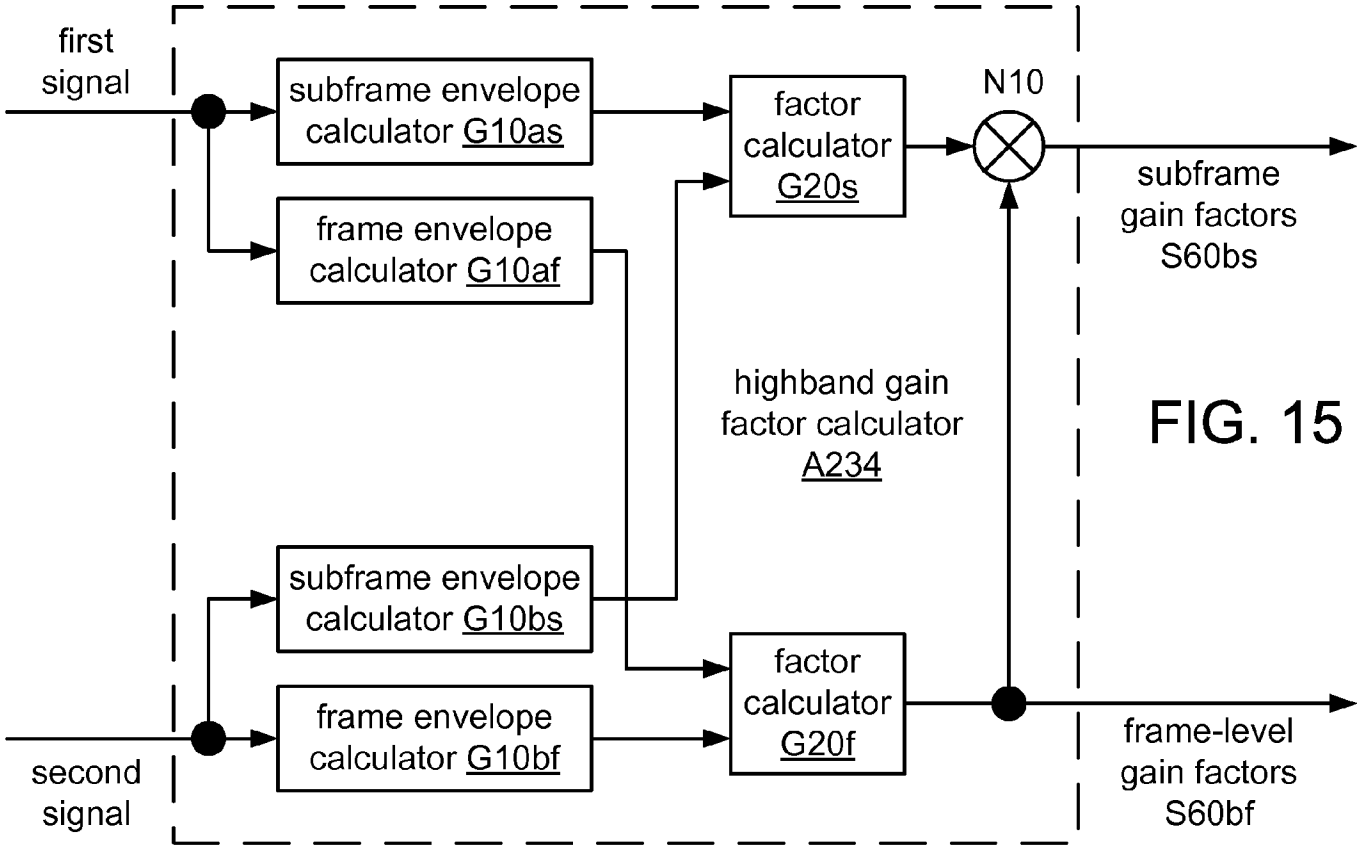
FIG. 15 shows a block diagram of an implementation A234 of highband gain factor calculator A232.

As noted above, it may be desirable to obtain gain factors at two or more different time resolutions. For example, it may be desirable for highband gain factor calculator A230 to be configured to calculate both frame-level gain factors and a series of subframe gain factors for each frame of highband signal S30 to be encoded. FIG. 15 shows a block diagram of an implementation A234 of highband gain factor calculator A232 that includes implementations G10*af*, G10*as* of envelope calculator G10 that are configured to calculate frame-level and subframe-level envelopes, respectively, of a first signal (e.g., synthesized highband signal S130, although implementations in which envelope calculators G10*af*, G10*as* are arranged to calculate envelopes of narrowband excitation signal S80 or highband excitation signal S120 instead are expressly contemplated and hereby disclosed). Highband gain factor calculator A234 also includes implementations G10*bf*, G10*bs* of envelope calculator G10*b* that are configured to calculate frame-level and subframe-level envelopes, respectively, of a second signal (e.g., highband signal S30).

Envelope calculators G10*af* and G10*bf* may be identical or may be instances of different implementations of envelope calculator G10. In some cases, envelope calculators G10*af* and G10*bf* may be implemented as the same structure (e.g., array of gates) and/or set of instructions (e.g., lines of code) configured to process different signals at different times. Likewise, envelope calculators G10*as* and G10*bs* may be identical, may be instances of different implementations of envelope calculator G10, or may be implemented as the same structure and/or set of instructions. It is even possible for all four envelope generators G10*af*, G10*as*, G10*bf*, and G10*bs* to be implemented as the same configurable structure and/or set of instructions at different times.

Implementations G20*f*, G20*s* of factor calculator G20 as described herein are arranged to calculate frame-level and subframe-level gain factors S60*bf*, S60*bs* based on the respective envelopes. Normalizer N10, which may be implemented as a multiplier or divider to suit the particular design, is arranged to normalize each set of subframe gain factors S60*bs* according to the corresponding frame-level gain factor S60*bf* (e.g., before the subframe gain factors are quantized). In some cases, it may be desired to obtain a possibly more accurate result by quantizing the frame-level gain factor S60*bf* and then using the corresponding dequantized value to normalize the subframe gain factors S60*bs*.

Figure 16:
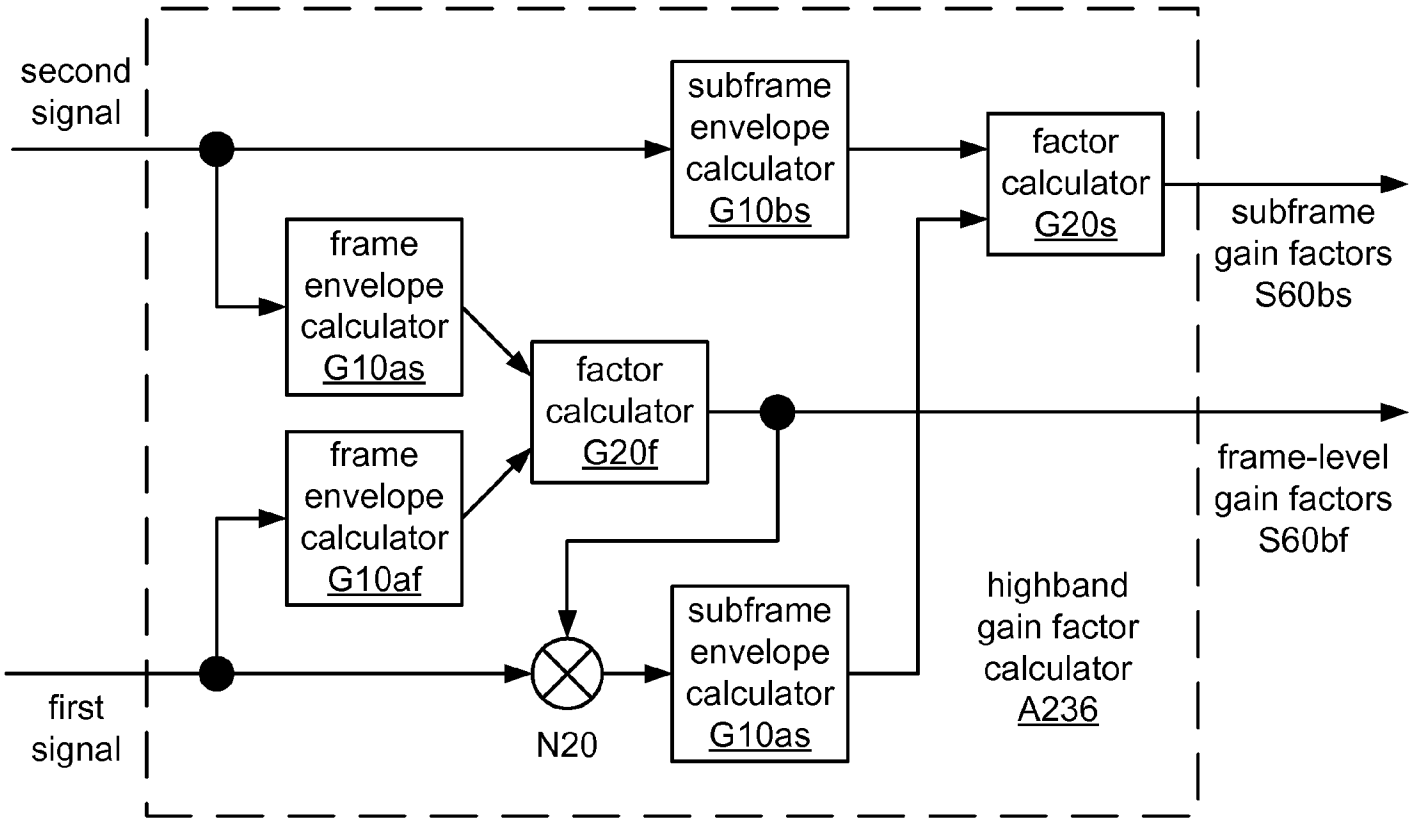
FIG. 16 shows a block diagram of another implementation A236 of highband gain factor calculator A232.

FIG. 16 shows a block diagram of another implementation A236 of highband gain factor calculator A232. In this implementation, various envelope and gain calculators as shown in FIG. 15 are rearranged such that normalization is performed on the first signal before the envelope is calculated. Normalizer N20 may be implemented as a multiplier or divider to suit the particular design. In some cases, it may be desired to obtain a possibly more accurate result by quantizing the frame-level gain factor S60*bf* and then using the corresponding dequantized value to normalize the first signal.

Quantizer 430 may be implemented according to any techniques known or to be developed to perform one or more methods of scalar and/or vector quantization deemed suitable for the particular design. Quantizer 430 may be configured to quantize the frame-level gain factors separately from the subframe gain factors. In one example, each frame-level gain factor S60*bf* is quantized using a four-bit lookup table quantizer, and the set of subframe gain factors S60*bs* for each frame is vector quantized using four bits. Such a scheme is used in the EVRC-WB coder for voiced speech frames (as noted in section 4.18.4 of the 3GPP2 document C.S0014-C version 0.2, available at www.3gpp2.org). In another example, each frame-level gain factor S60*bf* is quantized using a seven-bit scalar quantizer, and the set of subframe gain factors S60*bs* for each frame is vector quantized using a multistage vector quantizer with four bits per stage. Such a scheme is used in the EVRC-WB coder for unvoiced speech frames (as noted in section 4.18.4 of the 3GPP2 document C.S0014-C version 0.2 cited above). It is also possible that in other schemes, each frame-level gain factor is quantized together with the subframe gain factors for that frame.

Figure 17:
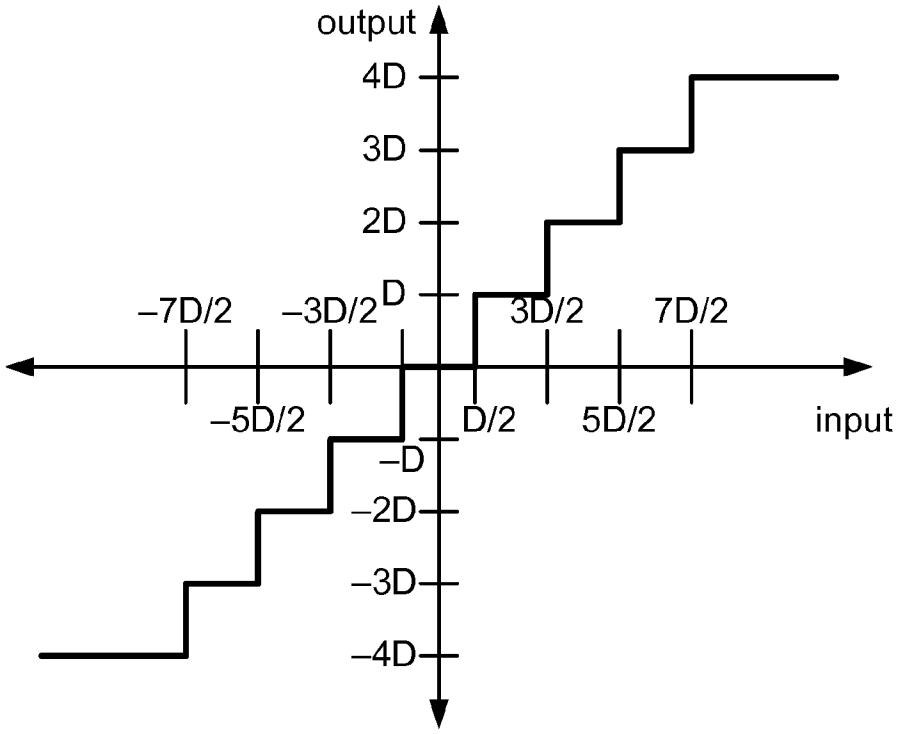
FIG. 17 shows an example of a one-dimensional mapping as may be performed by a scalar quantizer.

A quantizer is typically configured to map an input value to one of a set of discrete output values. A limited number of output values are available, such that a range of input values is mapped to a single output value. Quantization increases coding efficiency because an index that indicates the corresponding output value may be transmitted in fewer bits than the original input value. FIG. 17 shows one example of a one-dimensional mapping as may be performed by a scalar quantizer, in which input values between $(2nD-1)/2$ and $(2nD+1)/2$ are mapped to an output value $nD$ (for integer n).

Figure 18:
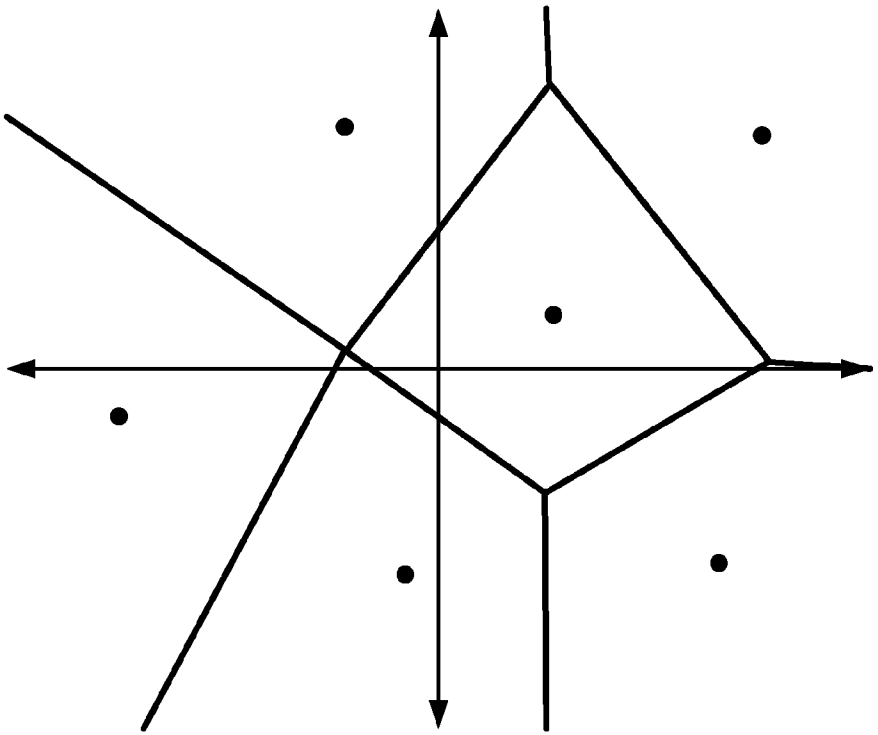
FIG. 18 shows one simple example of a multidimensional mapping as performed by a vector quantizer.

A quantizer may also be implemented as a vector quantizer. For example, the set of subframe gain factors for each frame is typically quantized using a vector quantizer. FIG. 18 shows one simple example of a multidimensional mapping as performed by a vector quantizer. In this example, the input space is divided into a number of Voronoi regions (e.g., according to a nearest-neighbor criterion). The quantization maps each input value to a value that represents the corresponding Voronoi region (typically, the centroid), shown here as a point. In this example, the input space is divided into six regions, such that any input value may be represented by an index having only six different states.

Figure 19A:
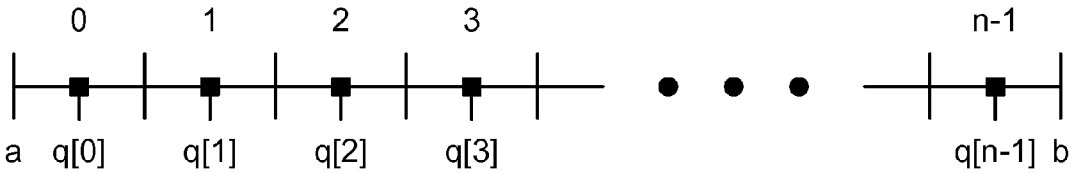
FIG. 19*a* shows another example of a one-dimensional mapping as may be performed by a scalar quantizer.

FIG. 19*a* shows another example of a one-dimensional mapping as may be performed by a scalar quantizer. In this example, an input space extending from some initial value a (e.g., 0 dB) to some terminal value b (e.g., 6 dB) is divided into n regions. Values in each of the n regions are represented by a corresponding one of n quantization values q[0] to q[n−1]. In a typical application, the set of n quantization values is available to the encoder and decoder, such that transmission of the quantization index (0 to n−1) is sufficient to transfer the quantized value from encoder to decoder. For example, the set of quantization values may be stored in an ordered list, table, or codebook within each device.

Figure 19B:
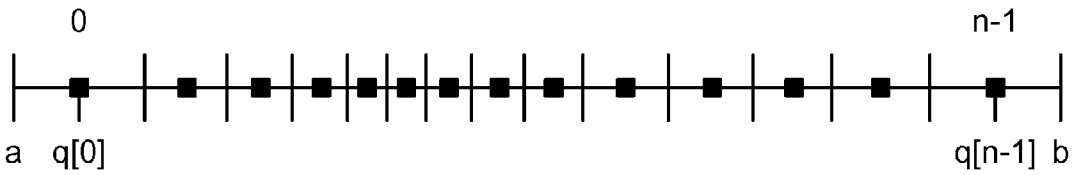
FIG. 19*b* shows an example of a mapping of an input space into quantization regions of different sizes.

Although FIG. 19*a* shows an input space divided into n equally sized regions, it may be desirable to divide the input space using regions of different sizes instead. It is possible that a more accurate average result may be obtained by distributing the quantization values according to an expected distribution of the input data. For example, it may be desirable to obtain a higher resolution (i.e., smaller quantization regions) in areas of the input space that are expected to be observed more often, and a lower resolution elsewhere. FIG. 19*b* shows an example of such a mapping. In another example, the sizes of the quantization regions increase as amplitude grows from a to b (e.g., logarithmically). Quantization regions of different sizes may also be used in vector quantization (e.g., as shown in FIG. 18). In quantizing frame-level gain factors S60*bf*, quantizer 430 may be configured to apply a mapping that is uniform or nonuniform as desired. Likewise, in quantizing subframe gain factors S60*bs*, quantizer 430 may be configured to apply a mapping that is uniform or nonuniform as desired. Quantizer 430 may be implemented to include separate quantizers for factors S60*bf* and S60*bs* and/or may be implemented to use the same configurable structure and/or set of instructions to quantize the different streams of gain factors at different times.

As described above, highband gain factors S60*b* encode a time-varying relation between an envelope of the original highband signal S30 and an envelope of a signal based on narrowband excitation signal S80 (e.g., synthesized highband signal S130). This relation may be reconstructed at the decoder such that the relative levels of the decoded narrowband and highband signals approximate those of the narrowband and highband components of the original wideband speech signal S10.

An audible artifact may occur if the relative levels of the various subbands in a decoded speech signal are inaccurate. For example, a noticeable artifact may occur when a decoded highband signal has a higher level (e.g., a higher energy) with respect to a corresponding decoded narrowband signal than in the original speech signal. Audible artifacts may detract from the user's experience and reduce the perceived quality of the coder. To obtain a perceptually good result, it may be desirable for the subband encoder (e.g., highband encoder A200) to be conservative in allocating energy to the synthesized signal. For example, it may be desirable to use a conservative quantization method to encode a gain factor value for the synthesized signal.

An artifact resulting from level imbalance may be especially objectionable for a situation in which the excitation for the amplified subband is derived from another subband.

Figure 19C:
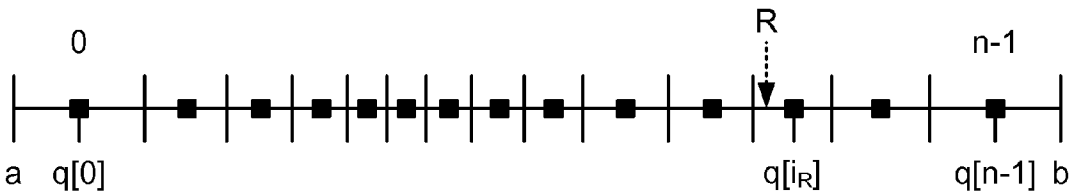
FIG. 19*c* illustrates an example in which the quantized value for a gain factor value R is greater than the original value.

Such an artifact may occur when, for example, a highband gain factor S60*b* is quantized to a value greater than its original value. FIG. 19*c* illustrates an example in which the quantized value for a gain factor value R is greater than the original value. The quantized value is denoted herein as $q[i_R]$, where $i_R$ indicates the quantization index associated with the value R and q[•] indicates the operation of obtaining the quantization value identified by the given index.

Figure 20A:
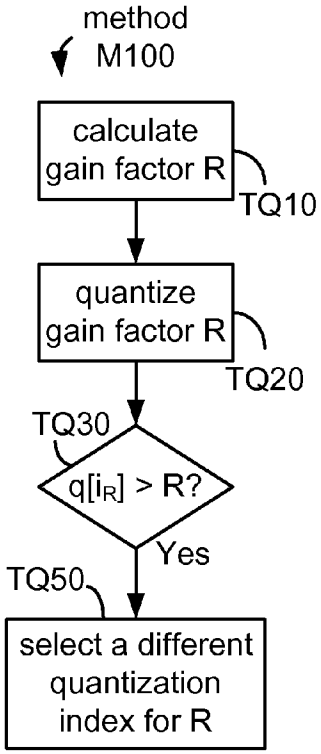
FIG. 20*a* shows a flowchart for a method M100 of gain factor limiting according to one general implementation.

FIG. 20*a* shows a flowchart for a method M100 of gain factor limiting according to one general implementation. Task TQ10 calculates a value R for a gain factor of a portion (e.g., a frame or subframe) of a subband signal. For example, task TQ10 may be configured to calculate the value R as the ratio of the energy of the original subband frame to the energy of a synthesized subband frame. Alternatively, the gain factor value R may be a logarithm (e.g., to base 10) of such a ratio. Task TQ10 may be performed by an implementation of highband gain factor calculator A230 as described above.

Task TQ20 quantizes the gain factor value R. Such quantization may be performed by any method of scalar quantization (e.g., as described herein) or any other method deemed suitable for the particular coder design, such as a vector quantization method. In a typical application, task TQ20 is configured to identify a quantization index $i_R$ corresponding to the input value R. For example, task TQ20 may be configured to select the index by comparing the value of R to entries in a quantization list, table, or codebook according to a desired search strategy (e.g., a minimum error algorithm). In this example, it is assumed that the quantization table or list is arranged in the decreasing order of the search strategy (i.e., such that $q[i-1] \leq q[i]$).

Task TQ30 evaluates a relation between the quantized gain value and the original value. In this example, task TQ30 compares the quantized gain value to the original value. If task TQ30 finds that the quantized value of R is not greater than the input value of R, then method M100 is concluded. However, if task TQ30 finds that the quantized value of R exceeds that of R, task TQ50 executes to select a different quantization index for R. For example, task TQ50 may be configured to select an index that indicates a quantization value less than $q[i_R]$.

Figure 20B:
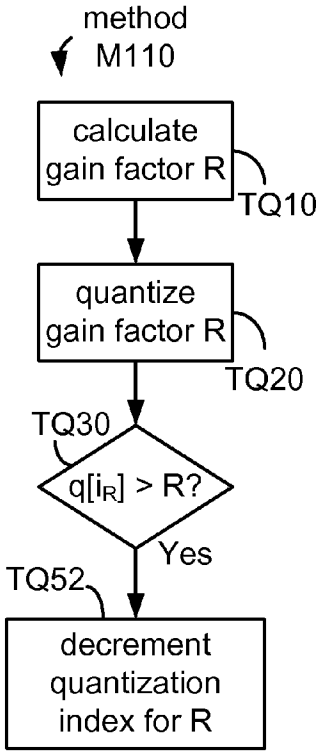
FIG. 20*b* shows a flowchart for an implementation M110 of method M100.

In a typical implementation, task TQ50 selects the next lowest value in the quantization list, table, or codebook. FIG. 20*b* shows a flowchart for an implementation M110 of method M100 that includes such an implementation TQ52 of task TQ50, where task TQ52 is configured to decrement the quantization index.

Figure 20C:
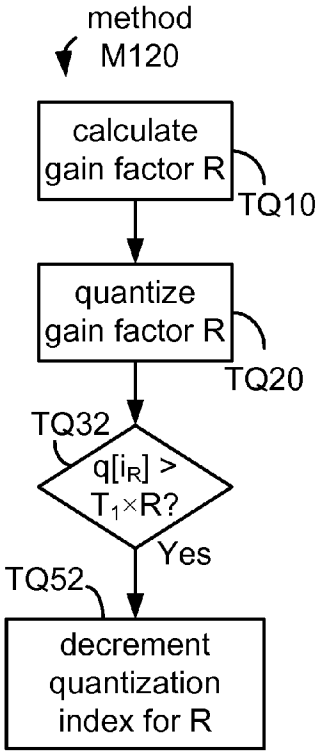
FIG. 20*c* shows a flowchart for an implementation M120 of method M100.

In some cases, it may be desirable to allow the quantized value of R to exceed the value of R by some nominal amount. For example, it may be desirable to allow the quantized value of R to exceed the value of R by some amount or proportion that is expected to have an acceptably low effect on perceptual quality. FIG. 20*c* shows a flowchart for such an implementation M120 of method Ml00. Method M120 includes an implementation TQ32 of task TQ30 that compares the quantized value of R to an upper limit greater than R. In this example, task TQ32 compares $q[i_R]$ to the product of R and a threshold $T_1$, where $T_1$ has a value greater than but close to unity (e.g., 1.1 or 1.2). if task TQ32 finds that the quantized value is greater than (alternatively, not less than) the product, then an implementation of task TQ50 executes. Other implementations of task TQ30 may be configured to determine whether a difference between the value of R and the quantized value of R meets and/or exceeds a threshold.

It is possible in some cases that selecting a lower quantization value for R will cause a larger discrepancy between the decoded signals than the original quantization value. For example, such a situation may occur when $q[i_R-1]$ is much less than the value of R. Further implementations of method M100 include methods in which the execution or configuration of task TQ50 is contingent upon testing of the candidate quantization value (e.g., $q[i_R-1]$).

Figure 20D:
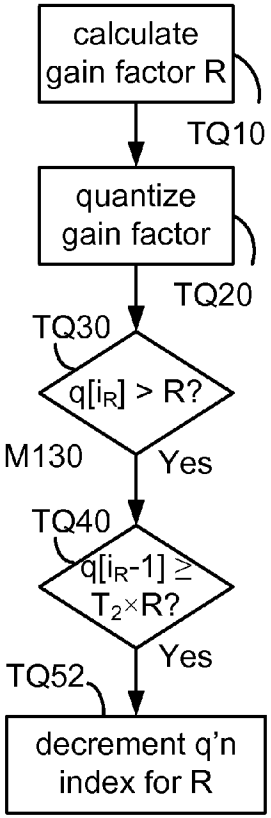
FIG. 20*d* shows a flowchart for an implementation M130 of method M100.

FIG. 20*d* shows a flowchart for such an implementation M130 of method M100. Method M130 includes a task TQ40 that compares the candidate quantization value (e.g., $q[i_R-1]$) to a lower limit less than R. In this example, task TQ40 compares $q[i_R-1]$ to the product of R and a threshold T2, where T2 has a value less than but close to unity (e.g., 0.8 or 0.9). If task TQ40 finds that the candidate quantization value is not greater than (alternatively, is less than) the product, then method M130 is concluded. If task TQ40 finds that the quantized value is greater than (alternatively, is not less than) the product, then an implementation of task TQ50 executes. Other implementations of task TQ40 may be configured to determine whether a difference between the candidate quantization value and the value of R meets and/or exceeds a threshold.

An implementation of method M100 may be applied to frame-level gain factors S60*bf* and/or to subframe gain factors S60*bs*. In a typical application, such a method is applied only to the frame-level gain factors. In the event that the method selects a new quantization index for a frame-level gain factor, it may be desirable to re-calculate the corresponding subframe gain factors S60*bs* based on the new quantized value of the frame-level gain factor. Alternatively, calculation of subframe gain factors S60*bs* may be arranged to occur after a method of gain factor limiting has been performed on the corresponding frame-level gain factor.

Figure 21:
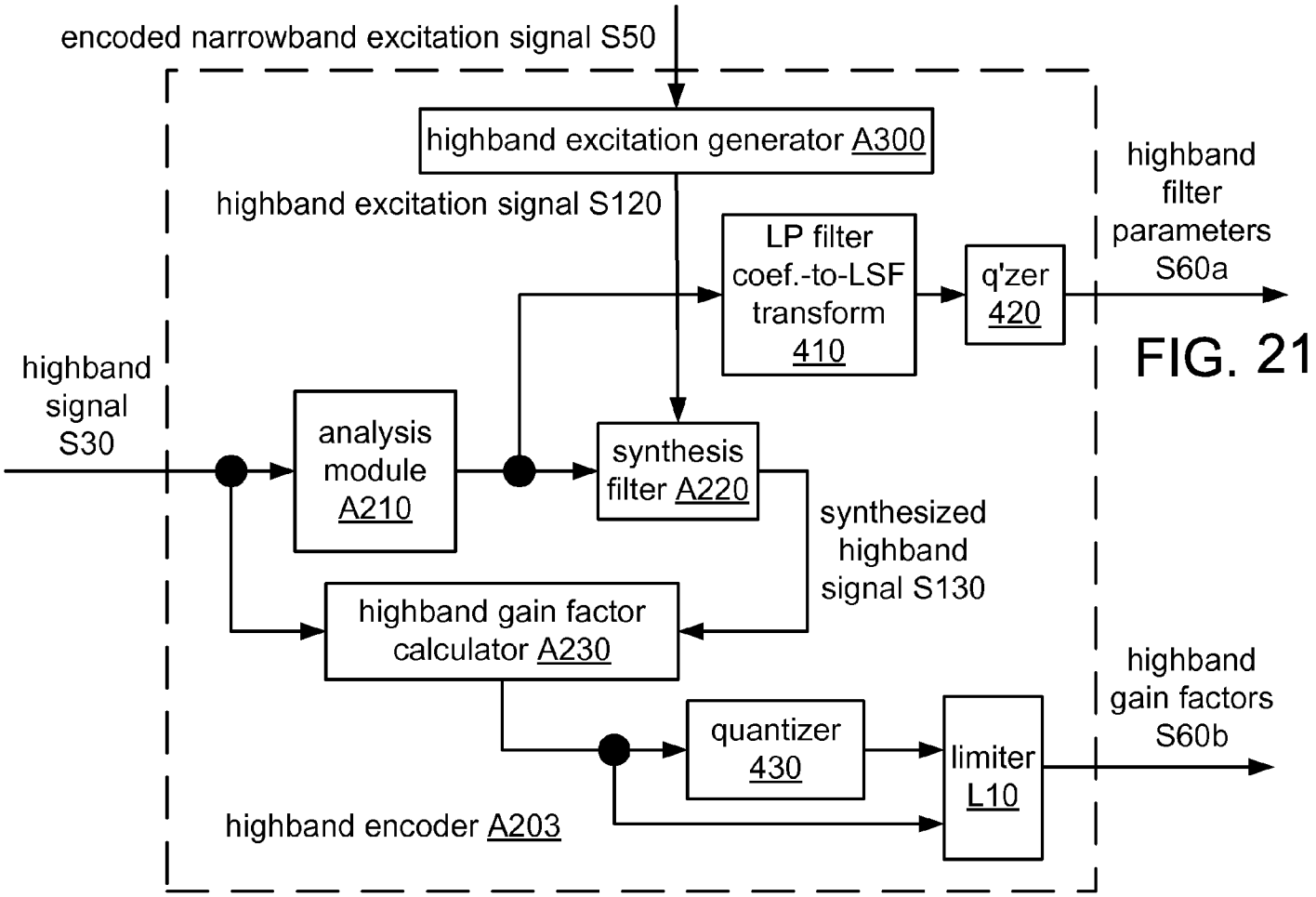
FIG. 21 shows a block diagram of an implementation A203 of highband encoder A202.
Figure 22:
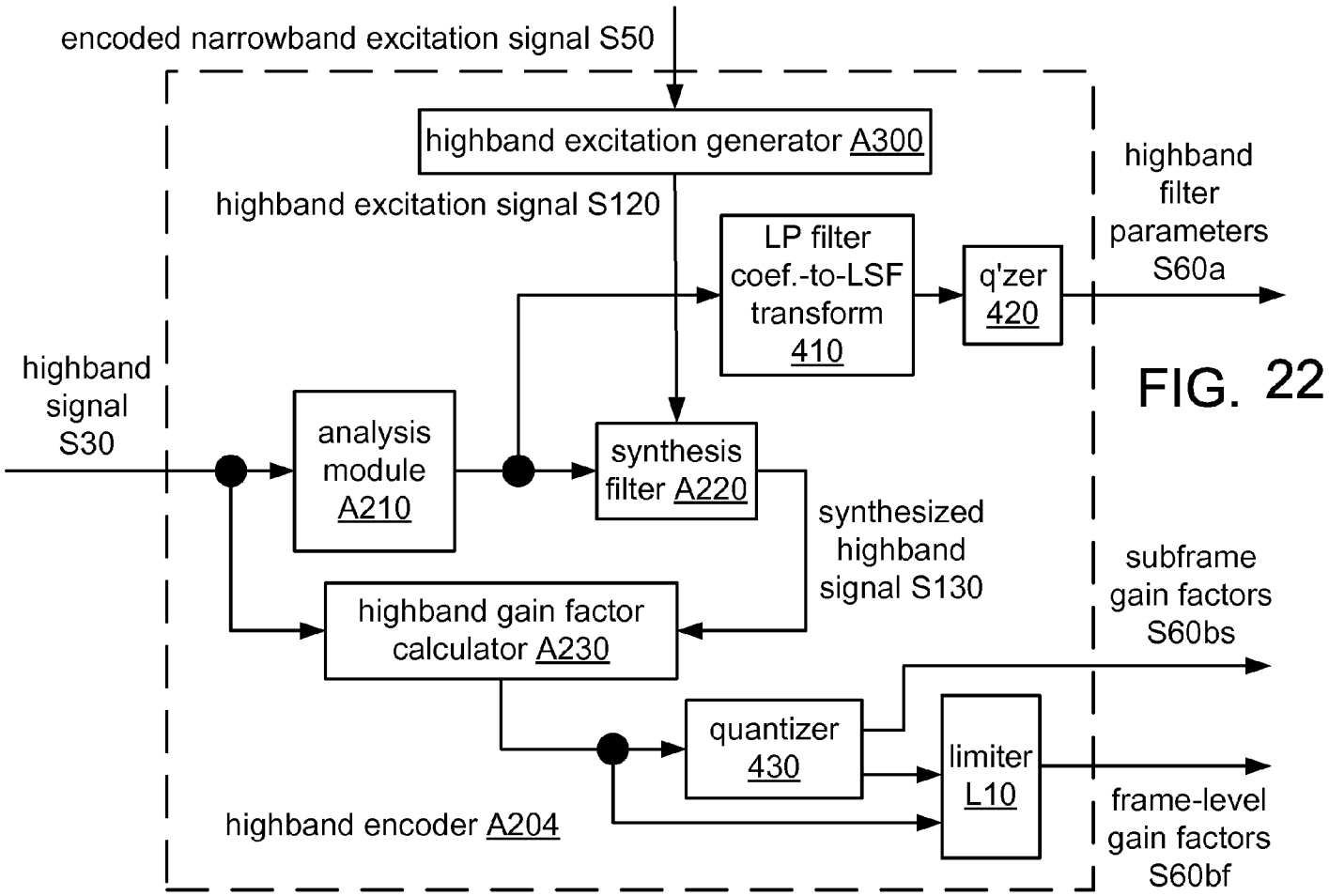
FIG. 22 shows a block diagram of an implementation A204 of highband encoder A203.

FIG. 21 shows a block diagram of an implementation A203 of highband encoder A202. Encoder A203 includes a gain factor limiter L10 that is arranged to receive the quantized gain factor values and their original (i.e., pre-quantization) values. Limiter L10 is configured to output highband gain factors S60*b* according to a relation between those values. For example, limiter L10 may be configured to perform an implementation of method M100 as described herein to output highband gain factors S60*b* as one or more streams of quantization indices. FIG. 22 shows a block diagram of an implementation A204 of highband encoder A203 that is configured to output subframe gain factors S60*bs* as produced by quantizer 430 and to output frame-level gain factors S60*bf* via limiter L10.

Figure 23A:
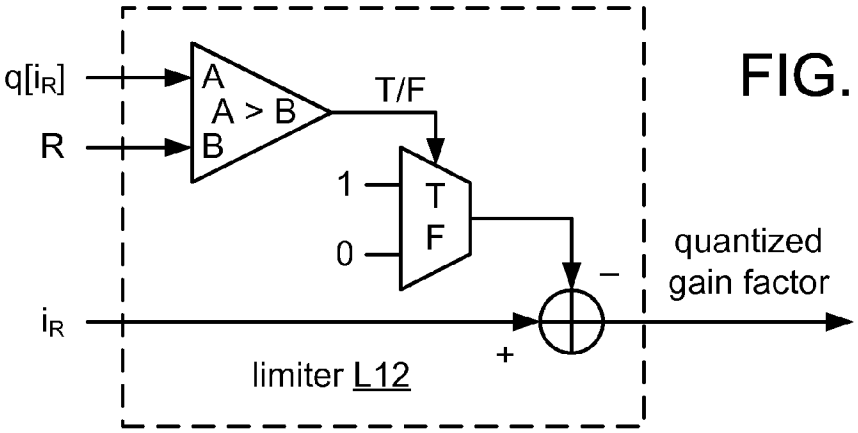
FIG. 23*a* shows an operational diagram for one implementation L12 of limiter L10.

FIG. 23*a* shows an operational diagram for one implementation L12 of limiter L10. Limiter L12 compares the pre- and post-quantization values of R to determine whether $q[i_R]$ is greater than R. If this expression is true, then limiter L12 selects another quantization index by decrementing the value of index $i_R$ by one to produce a new quantized value for R. Otherwise, the value of index $i_R$ is not changed.

Figure 23B:
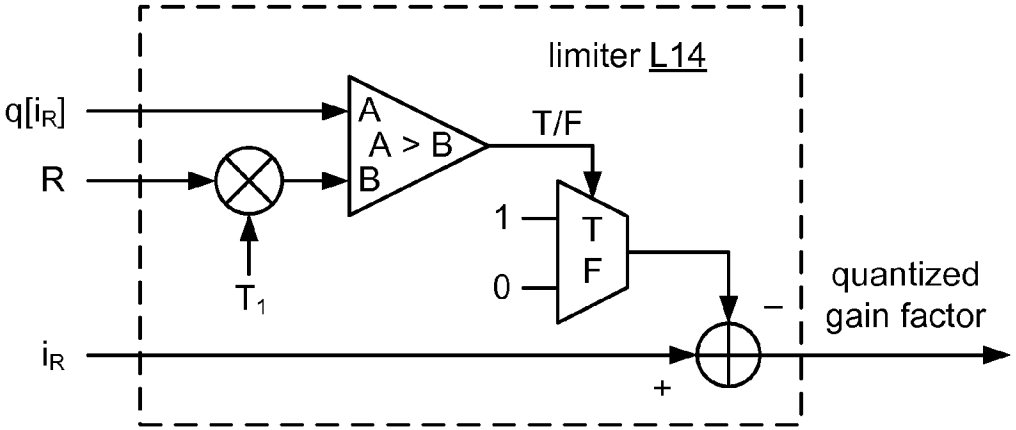
FIG. 23*b* shows an operational diagram for another implementation L14 of limiter L10.

FIG. 23*b* shows an operational diagram for another implementation L14 of limiter L10. In this example, the quantized value is compared to the product of the value of R and a threshold $T_1$, where $T_1$ has a value greater than but close to unity (e.g., 1.1 or 1.2). If $q[i_R]$ is greater than (alternatively, not less than) $T_1R$, limiter L14 decrements the value of index $i_R$.

Figure 23C:
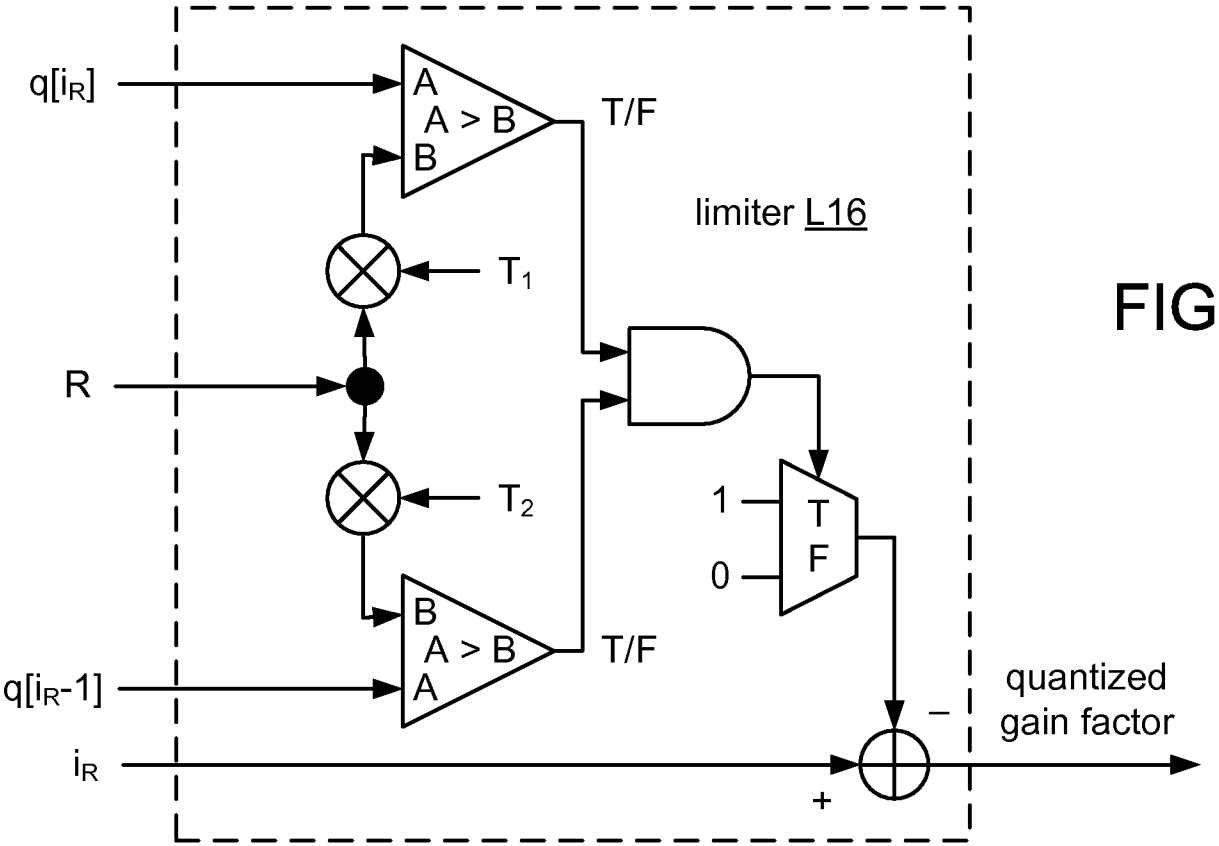
FIG. 23*c* shows an operational diagram for a further implementation L16 of limiter L10.

FIG. 23*c* shows an operational diagram for a further implementation L16 of limiter L10, which is configured to determine whether the quantization value proposed to replace the current one is close enough to the original value of R. For example, limiter L16 may be configured to perform an additional comparison to determine whether the next lowest indexed quantization value (e.g., $q[i_R-1]$) is within a specified distance from, or within a specified proportion of, the pre-quantized value of R. In this particular example, the candidate quantization value is compared to the product of the value of R and a threshold $T_2$, where $T_2$ has a value less than but close to unity (e.g., 0.8 or 0.9). If $q[i_R-1]$ is less than (alternatively, not greater than) $T_2R$, the comparison fails. If either of the comparisons performed on $q[i_R]$ and $q[i_R-1]$ fails, the value of index $i_R$ is not changed.

It is possible for variations among gain factors to give rise to artifacts in the decoded signal, and it may be desirable to configure highband encoder A200 to perform a method of gain factor smoothing (e.g., by applying a smoothing filter such as a one-tap IIR filter). Such smoothing may be applied to frame-level gain factors S60*bf* and/or to subframe gain factors S60*bs*. In such case, an implementation of limiter L10 and/or method M100 as described herein may be arranged to compare the quantized value $i_R$ to the pre-smoothed value of R. Additional description and figures relating to such gain factor smoothing may be found in Ser. No. 11/408,390 (Vos et al.), entitled "SYSTEMS, METHODS, AND APPARATUS FOR GAIN FACTOR SMOOTHING," filed Apr. 21, 2006, at FIGS. 48-55*b* and the accompanying text (including paragraphs [000254]-[000272]), and this material is hereby incorporated by reference, in the United States and any other jurisdiction allowing incorporation by reference, for the purpose of providing additional disclosure relating to gain factor smoothing.

If an input signal to a quantizer is very smooth, it can happen sometimes that the quantized output is much less smooth, according to a minimum step between values in the output space of the quantization. Such an effect may lead to audible artifacts, and it may be desirable to reduce this effect for gain factors. In some cases, gain factor quantization performance may be improved by implementing quantizer 430 to incorporate temporal noise shaping. Such shaping may be applied to frame-level gain factors S60*bf* and/or to subframe gain factors S60*bs*. Additional description and figures relating to quantization of gain factors using temporal noise shaping may be found in Ser. No. 11/408,390 at FIGS. 48-55*b* and the accompanying text (including paragraphs [000254]-[000272]), and this material is hereby incorporated by reference, in the United States and any other jurisdiction allowing incorporation by reference, for the purpose of providing additional disclosure relating to quantization of gain factors using temporal noise shaping.

For a case in which highband excitation signal S120 is derived from an excitation signal that has been regularized, it may be desired to time-warp the temporal envelope of highband signal S30 according to the time-warping of the source excitation signal. Additional description and figures relating to such time-warping may be found in the U.S. Pat. Appl. of Vos et al. entitled "SYSTEMS, METHODS, AND APPARATUS FOR HIGHBAND TIME WARPING," filed Apr. 3, 2006, Ser. No. 11/397,370 at FIGS. 25-29 and the accompanying text (including paragraphs [000157]-[000187]), and this material is hereby incorporated by reference, in the United States and any other jurisdiction allowing incorporation by reference, for the purpose of providing additional disclosure relating to time-warping of the temporal envelope of highband signal S30.

A degree of similarity between highband signal S30 and synthesized highband signal S130 may indicate how well the decoded highband signal S100 will resemble highband signal S30. Specifically, a similarity between temporal envelopes of highband signal S30 and synthesized highband signal S130 may indicate that decoded highband signal S100 can be expected to have a good sound quality and be perceptually similar to highband signal S30. A large variation over time between the envelopes may be taken as an indication that the synthesized signal is very different from the original, and in such case it may be desirable to identify and attenuate those gain factors before quantization. Additional description and figures relating to such gain factor attenuation may be found in the U.S. Pat. Appl. of Vos et al. entitled "SYSTEMS, METHODS, AND APPARATUS FOR GAIN FACTOR ATTENUATION," filed Apr. 21, 2006, Ser. No. 11/408,511 at FIGS. 34-39 and the accompanying text (including paragraphs [000222]-[000236]), and this material is hereby incorporated by reference, in the United States and any other jurisdiction allowing incorporation by reference, for the purpose of providing additional disclosure relating to gain factor attenuation.

Figure 24:
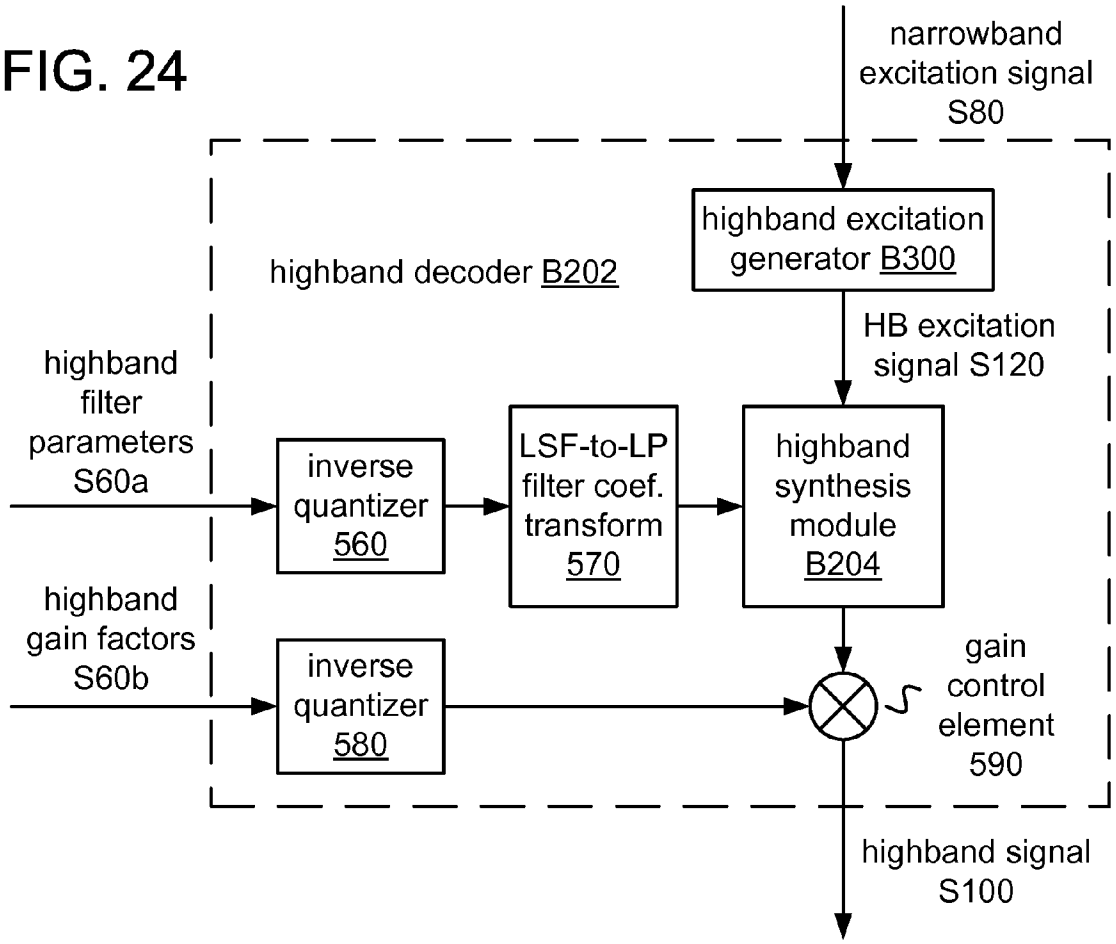
FIG. 24 shows a block diagram for an implementation B202 of highband decoder B200.

FIG. 24 shows a block diagram of an implementation B202 of highband decoder B200. Highband decoder B202 includes a highband excitation generator B300 that is configured to produce highband excitation signal S120 based on narrowband excitation signal S80. Depending on the particular system design choices, highband excitation generator B300 may be implemented according to any of the implementations of highband excitation generator A300 as mentioned herein. Typically it is desirable to implement highband excitation generator B300 to have the same response as the highband excitation generator of the highband encoder of the particular coding system. Because narrowband decoder B110 will typically perform dequantization of encoded narrowband excitation signal S50, however, in most cases highband excitation generator B300 may be implemented to receive narrowband excitation signal S80 from narrowband decoder B110 and need not include an inverse quantizer configured to dequantize encoded narrowband excitation signal S50. It is also possible for narrowband decoder B110 to be implemented to include an instance of anti-sparseness filter 600 arranged to filter the dequantized narrowband excitation signal before it is input to a narrowband synthesis filter such as filter 330.

Inverse quantizer 560 is configured to dequantize highband filter parameters S60*a* (in this example, to a set of LSFs), and LSF-to-LP filter coefficient transform 570 is configured to transform the LSFs into a set of filter coefficients (for example, as described above with reference to inverse quantizer 240 and transform 250 of narrowband encoder Al22). In other implementations, as mentioned above, different coefficient sets (e.g., cepstral coefficients) and/or coefficient representations (e.g., ISPs) may be used. Highband synthesis filter B204 is configured to produce a synthesized highband signal according to highband excitation signal S120 and the set of filter coefficients. For a system in which the highband encoder includes a synthesis filter (e.g., as in the example of encoder A202 described above), it may be desirable to implement highband synthesis filter B204 to have the same response (e.g., the same transfer function) as that synthesis filter.

Highband decoder B202 also includes an inverse quantizer 580 configured to dequantize highband gain factors S60*b*, and a gain control element 590 (e.g., a multiplier or amplifier) configured and arranged to apply the dequantized gain factors to the synthesized highband signal to produce highband signal S100. For a case in which the gain envelope of a frame is specified by more than one gain factor, gain control element 590 may include logic configured to apply the gain factors to the respective subframes, possibly according to a windowing function that may be the same or a different windowing function as applied by a gain calculator (e.g., highband gain calculator A230) of the corresponding highband encoder. In other implementations of highband decoder B202, gain control element 590 is similarly configured but is arranged instead to apply the dequantized gain factors to narrowband excitation signal S80 or to highband excitation signal S120. Gain control element 590 may also be implemented to apply gain factors at more than one temporal resolution (e.g., to normalize the input signal according to a frame-level gain factor, and to shape the resulting signal according to a set of subframe gain factors).

An implementation of narrowband decoder B110 according to a paradigm as shown in FIG. 8 may be configured to output narrowband excitation signal S80 to highband decoder B200 after the long-term structure (pitch or harmonic structure) has been restored. For example, such a decoder may be configured to output narrowband excitation signal S80 as a dequantized version of encoded narrowband excitation signal S50. Of course, it is also possible to implement narrowband decoder B110 such that highband decoder B200 performs dequantization of encoded narrowband excitation signal S50 to obtain narrowband excitation signal S80.

Although they are largely described as applied to highband encoding, the principles disclosed herein may be applied to any coding of a subband of a speech signal relative to another subband of the speech signal. For example, the encoder filter bank may be configured to output a lowband signal to a lowband encoder (in the alternative to or in addition to one or more highband signals), and the lowband encoder may be configured to perform a spectral analysis of the lowband signal, to extend the encoded narrowband excitation signal, and to calculate a gain envelope for the encoded lowband signal relative to the original lowband signal. For each of these operations, it is expressly contemplated and hereby disclosed that the lowband encoder may be configured to perform such operation according to any of the full range of variations as described herein.

The foregoing presentation of the described configurations is provided to enable any person skilled in the art to make or use the structures and principles disclosed herein. Various modifications to these configurations are possible, and the generic principles presented herein may be applied to other configurations as well. For example, an configuration may be implemented in part or in whole as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

The various elements of implementations of highband gain factor calculator A230, highband encoder A200, highband decoder B200, wideband speech encoder A100, and wideband speech decoder B100 may be implemented as electronic and/or optical devices residing, for example, on the same chip or among two or more chips in a chipset, although other arrangements without such limitation are also contemplated. One or more elements of such an apparatus (e.g., highband gain factor calculator A230, quantizer 430, and/or limiter L10) may be implemented in whole or in part as one or more sets of instructions arranged to execute on one or more fixed or programmable arrays of logic elements (e.g., transistors, gates) such as microprocessors, embedded processors, IP cores, digital signal processors, FPGAs (field-programmable gate arrays), ASSPs (application-specific standard products), and ASICs (application-specific integrated circuits). It is also possible for one or more such elements to have structure in common (e.g., a processor used to execute portions of code corresponding to different elements at different times, a set of instructions executed to perform tasks corresponding to different elements at different times, or an arrangement of electronic and/or optical devices performing operations for different elements at different times). Moreover, it is possible for one or more such elements to be used to perform tasks or execute other sets of instructions that are not directly related to an operation of the apparatus, such as a task relating to another operation of a device or system in which the apparatus is embedded.

Configurations also include additional methods of speech coding, encoding, and decoding as are expressly disclosed herein, e.g., by descriptions of structures configured to perform such methods. Each of these methods may also be tangibly embodied (for example, in one or more data storage media as listed above) as one or more sets of instructions readable and/or executable by a machine including an array of logic elements (e.g., a processor, microprocessor, microcontroller, or other finite state machine). For example, the range of configurations includes a computer program product comprising a computer-readable medium having code for causing at least one computer to, based on a relation between (A) a portion in time of a first signal based on a first subband of a speech signal and (B) a corresponding portion in time of a second signal based on a component derived from a second subband of the speech signal, calculate a gain factor value; code for causing at least one computer to, according to the gain factor value, select a first index into an ordered set of quantization values; code for causing at least one computer to evaluate a relation between the gain factor value and a quantization value indicated by the first index; and code for causing at least one computer to, according to a result of said evaluating, select a second index into the ordered set of quantization values. Thus, the present disclosure is not intended to be limited to the configurations shown above but rather is to be accorded the widest scope consistent with the principles and novel features disclosed in any fashion herein, including in the attached claims as filed, which form a part of the original disclosure.

What is claimed is:

1. A method of speech processing, said method comprising:

by a speech encoder, and based on a relation between (A) a portion in time of a first signal based on a first subband of a speech signal and (B) a corresponding portion in time of a second signal based on a component derived from a second subband of the speech signal, calculating a gain factor value;

by the speech encoder, and according to the gain factor value, selecting a first index into an ordered set of quantization values;

by the speech encoder, evaluating a relation between the gain factor value and a quantization value indicated by the first index; and by the speech encoder, and according to a result of said evaluating, selecting a second index into the ordered set of quantization values, wherein said evaluating a relation comprises determining whether the quantization value indicated by the first index exceeds the gain factor value, and wherein the first index indicates the quantization value among the ordered set that is closest to the gain factor value.

2. A method of speech processing, said method comprising:

by a speech encoder, and based on a relation between (A) a portion in time of a first signal based on a first subband of a speech signal and (B) a corresponding portion in time of a second signal based on a component derived from a second subband of the speech signal, calculating a gain factor value;

by the speech encoder, and according to the gain factor value, selecting a first index into an ordered set of quantization values;

by the speech encoder, evaluating a relation between the gain factor value and a quantization value indicated by the first index; and by the speech encoder, and according to a result of said evaluating, selecting a second index into the ordered set of quantization values, wherein said evaluating a relation comprises determining whether the quantization value indicated by the first index exceeds the gain factor value, and wherein the second index indicates the quantization value among the ordered set that is closest to the gain factor value without exceeding the gain factor value, and wherein the first index indicates the quantization value among the ordered set that is closest to the gain factor value.

3. A non-transitory computer-readable data storage medium comprising:

code for causing a speech encoder to calculate, based on a relation between (A) a portion in time of a first signal that is based on a first subband of a speech signal and (B) a corresponding portion in time of a second signal that is based on a component derived from a second subband of the speech signal, a gain factor value;

code for causing the speech encoder to select, according to the gain factor value, a first index into an ordered set of quantization values;

code for causing the speech encoder to determine that a quantization value indicated by the first index is not less than a value that is based on the gain factor value; and code for causing the speech encoder to select, in response to said determining, a second index into the ordered set of quantization values.

4. A speech encoder for encoding a speech signal as a stream of coding parameters, said speech encoder comprising:

a calculator configured to calculate a gain factor value based on a relation between (A) a portion in time of a first signal that is based on a first subband of the speech signal and (B) a corresponding portion in time of a second signal that is based on a component derived from a second subband of the speech signal;

a quantizer configured to select, according to the gain factor value, a first index into an ordered set of quantization values; and a limiter configured (A) to determine that a quantization value indicated by the first index is not less than a value that is based on the gain factor value and (B) to select, in response to the determination, a second index into the ordered set of quantization values, wherein said stream of coding parameters includes said second index.

5. The apparatus according to claim 4, wherein the portion in time of the first signal is a frame of the first signal, and wherein the corresponding portion in time of the second signal is a frame of the second signal.

6. The apparatus according to claim 4, wherein the first subband is a highband signal, and wherein the second subband is a narrowband signal.

7. The apparatus according to claim 4, wherein the component derived from a second subband of the speech signal is an encoded excitation signal.

8. The apparatus according to claim 7, wherein the second signal is also based on a spectral envelope of the first subband.

9. The apparatus according to claim 4, wherein said calculator is configured to calculate the gain factor value based on a ratio between a measure of energy of the portion in time of the first signal and a measure of energy of the corresponding portion in time of the second signal.

10. The apparatus according to claim 4, wherein said limiter is configured to determine that a quantization value indicated by the first index is not less than a value that is based on the gain factor value by determining that the quantization value indicated by the first index exceeds the gain factor value.

11. The apparatus according to claim 4, wherein said limiter is configured to determine that a quantization value indicated by the first index is not less than a value that is based on the gain factor value by at least one among (C) determining that the quantization value indicated by the first index exceeds the gain factor value by a predetermined amount and (D) determining that the quantization value indicated by the first index exceeds the gain factor value by a particular proportion of the gain factor value.

12. The apparatus according to claim 4, wherein the second index indicates the quantization value among the ordered set that is closest to the gain factor value without exceeding the gain factor value.

13. The apparatus according to claim 12, wherein the first index indicates the quantization value among the ordered set that is closest to the gain factor value.

14. The apparatus according to claim 4, wherein said limiter is configured to determine whether the quantization value indicated by the second index is within a particular proportion of the gain factor value.

15. The apparatus according to claim 4, said apparatus comprising a cellular telephone having an encoder including said calculator, said quantizer, and said limiter.

16. The apparatus according to claim 4, said apparatus comprising a device configured to transmit a plurality of packets having a format compliant with a version of the Internet Protocol, wherein the plurality of packets includes parameters encoding the first subband, parameters encoding the second subband, and the second index.

17. The apparatus for speech processing according to claim 4, wherein said apparatus comprises a normalizer configured to use a quantization value indicated by the second index to normalize each of a plurality of subframe gain factors.

18. A speech encoder for encoding a speech signal as a stream of coding parameters, said speech encoder comprising:

means for calculating a gain factor value based on a relation between (A) a portion in time of a first signal that is based on a first subband of the speech signal and (B) a corresponding portion in time of a second signal that is based on a component derived from a second subband of the speech signal;

means for selecting, according to the gain factor value, a first index into an ordered set of quantization values; and means for determining that a quantization value indicated by the first index is not less than a value that is based on the gain factor value and for selecting, in response to said determining, a second index into the ordered set of quantization values, wherein said stream of coding parameters includes said second index.

19. The apparatus according to claim 18, wherein the component derived from a second subband of the speech signal is an encoded excitation signal.

20. The apparatus according to claim 19, wherein the second signal is also based on a spectral envelope of the first subband.

21. The apparatus according to claim 18, wherein said means for calculating is configured to calculate the gain factor value based on a ratio between a measure of energy of the portion in time of the first signal and a measure of energy of the corresponding portion in time of the second signal.

22. The apparatus according to claim 18, wherein the first index indicates the quantization value among the ordered set that is closest to the gain factor value, and wherein the second index indicates the quantization value among the ordered set that is closest to the gain factor value without exceeding the gain factor value.

23. A method of speech processing, said method comprising:

by a speech encoder, and based on a relation between (A) a portion in time of a first signal that is based on a first subband of a speech signal and (B) a corresponding portion in time of a second signal that is based on a component derived from a second subband of the speech signal, calculating a gain factor value;

by the speech encoder, and according to the gain factor value, selecting a first index into an ordered set of quantization values;

by the speech encoder, determining that a quantization value indicated by the first index is not less than a value that is based on the gain factor value; and by the speech encoder, and in response to said determining, selecting a second index into the ordered set of quantization values.

24. The method according to claim 23, wherein said value that is based on the gain factor value is the gain factor value, and wherein said determining that a quantization value indicated by the first index is not less than a value that is based on the gain factor value is performed by determining that a quantization value indicated by the first index exceeds the gain factor value.

25. The method of speech processing according to claim 23, wherein said determining that a quantization value indicated by the first index is not less than a value that is based on the gain factor value comprises at least one among (C) determining whether the quantization value indicated by the first index exceeds the gain factor value by a predetermined amount and (D) determining whether the quantization value indicated by the first index exceeds the gain factor value by a particular proportion of the gain factor value.

26. The method of speech processing according to claim 23, wherein the second index indicates the quantization value among the ordered set that is closest to the gain factor value without exceeding the gain factor value.

27. The method of speech processing according to claim 23, wherein said method comprises using a quantization value indicated by the second index to normalize each of a plurality of subframe gain factors.

28. The method of speech processing according to claim 23, wherein said selecting a second index comprises determining whether a quantization value indicated by the second index is within a particular proportion of the gain factor value.

* * * * *